United States Patent [19]

Thompson

[11] Patent Number: 4,478,336

[45] Date of Patent: Oct. 23, 1984

[54] VARIABLE TEST AIR APPARATUS

[75] Inventor: Roger A. Thompson, Littleton, Colo.

[73] Assignee: Adolph Coors Company, Golden, Colo.

[21] Appl. No.: 441,433

[22] Filed: Nov. 15, 1982

[51] Int. Cl.[3] ..... B07C 5/10

[52] U.S. Cl. ..... 209/588; 73/45.1; 356/240

[58] Field of Search ..... 209/588, 587, 577, 528; 356/237, 240; 73/45, 45.1, 45.2

[56] References Cited

U.S. PATENT DOCUMENTS

| | | | |
|---|---|---|---|
| 3,749,923 | 7/1973 | Husome | 356/240 X |
| 3,750,877 | 8/1973 | Dvacho et al. | 356/237 X |
| 4,074,809 | 2/1978 | McMillin et al. | 209/588 |
| 4,105,122 | 8/1978 | Flood et al. | 209/588 X |

*Primary Examiner*—Anthony V. Ciarlante
*Assistant Examiner*—Joseph W. Roskos
*Attorney, Agent, or Firm*—Klaas & Law

[57] ABSTRACT

A variable speed machine for continuous testing of articles by use of processing air including: a shaft member rotatably supported on a frame and driven by a variable speed motor, a transfer wheel with a plurality of article holding pockets affixed to the shaft member, sealing apparatus mounted on the shaft member and associated with each article holding pocket and an extendable and retractable apparatus for sealingly engaging a portion of an article carried by an associated pocket during a testing period, pressurizing apparatus associated with the sealing apparatus for providing pressurized air to the seal and the test article, control valve apparatus for regulating the air pressure to the seal and the test article, shaft rotational speed monitoring apparatus providing a speed based signal and processing means for controlling operation of the control valve apparatus based on the speed based signal to provide an optimum air pressure to the sealing apparatus and associated test article.

48 Claims, 17 Drawing Figures

FIG. 8
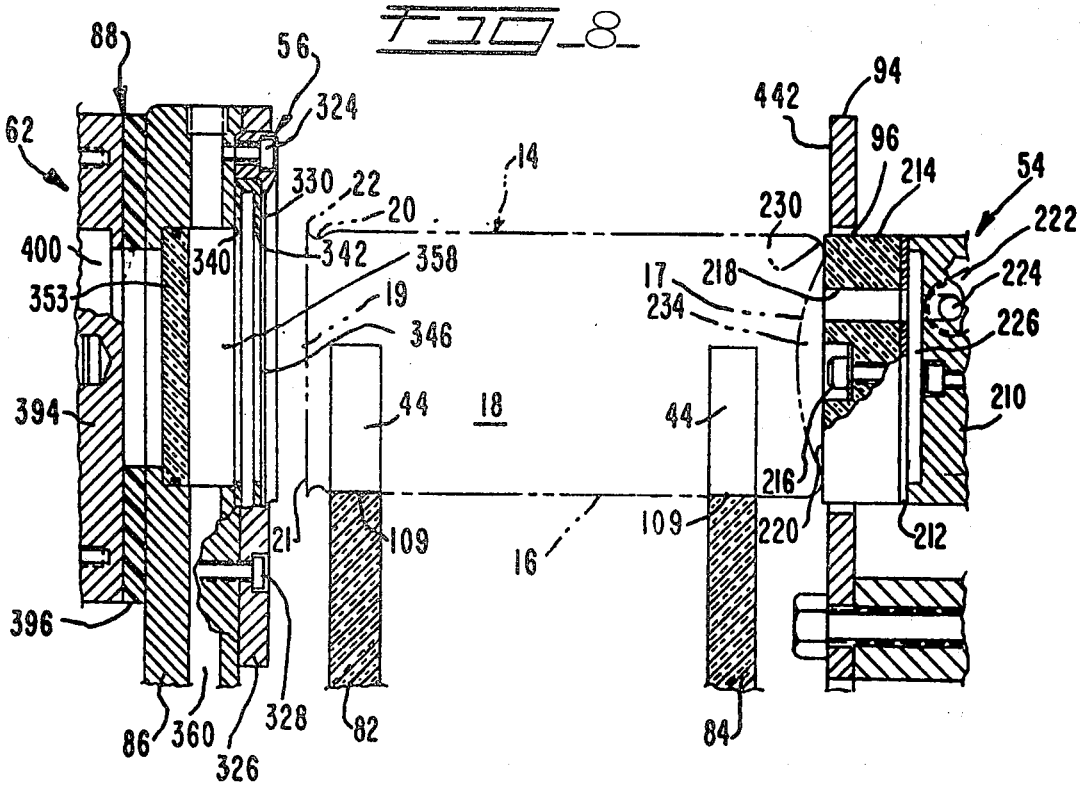
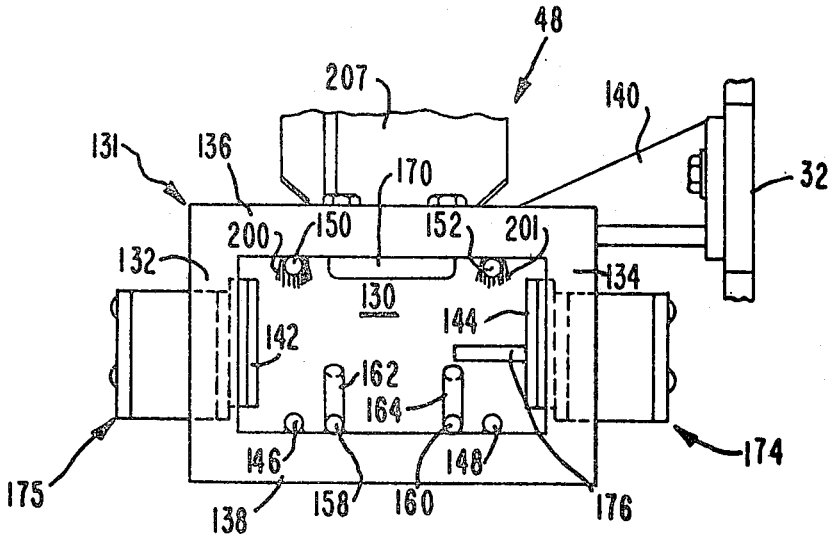
FIG. 10

VARIABLE TEST AIR APPARATUS

BACKGROUND OF THE INVENTION

The invention relates generally to the use of pressurized air in high speed production line type machines and more particularly to apparatus for varying the pressure of air used in a variable speed metal can inspection machine.

The present invention is particularly adapted for use in the inspection of metal can bodies by a machine such as described in U.S. Pat. No. 4,074,809 issued to McMillin et al., which is hereby incorporated by reference. In machines of this type pressurized air is used to aid in forming a light tight seal at one end of a can body member. Air is also used to pressurize the interior of can body members to aid in the detection of can body defects such as pin holes or small slits in the can body wall and irregularities in the rim surface of the can body.

Machines of the type described in McMillin et al are operated over a relatively broad speed range, typically from approximately 600 to approximately 1200 cans per minute, to accommodate the changing rate of can delivery from an associated infeed track. An even broader dynamic operating range is generally desirable; however, it has been found that the amount of air pressure which must be applied at an air manifold to achieve a desired sealing pressure is not constant with the machine speed. A pressure setting at the manifold sufficient to provide proper seals at a low speed setting is insufficient for sealing at higher speeds. Conversely, higher pressure settings which allow adequate pressurization of can bodies and seals at higher speeds cause the seals to be blown off at lower speeds. The improper seal formation produced under either condition causes an associated photomultiplier to sense the pressence of light and reject the can body associated with the improperly formed seal whether or not is is actually defective. Thus, either a high or low pressure setting will result in increased scrap. A high pressure setting will also result in physical damage to the sealing apparatus at low speed operation. The problem may not be avoided by running the machine only at the high speed setting because of problems associated with high speed loading and the presence of empty pockets within the machine.

Thus it is desirable to provide apparatus to vary the pressure of air used in forming light tight seals and in pressurizing can bodies to allow a can body inspection machine to be operated over a very broad dynamic range. It is also generally desirable to provide apparatus which may be adapted for use in other high speed machines using pressurized air having pressure parameters which vary with the machine operating speed.

SUMMARY OF THE INVENTION

The present invention comprises apparatus for controlling the pressure of air used in a high speed testing machine of a type which is operable over a relatively large dynamic range.

The apparatus comprises a monitoring means sensitive to the speed of operation of the testing machine which provides a control signal which may be processed by a data processing means. The data processing means provides command signals based on the speed monitor input to control circuitry of a pressure control valve whereby air is provided by the pressure control valve at a predetermined pressure which is optimum for the particular speed of operation of the testing machine.

The monitoring means and the data processing means may comprise any of a number of devices used for such purposes. For example, a mechanical system of drive gears could be linked directly from a rotary element of the machine to a generator device providing a variable strength electrical output to a solenoid control valve. Alternately, the monitoring means might provide an electronic signal which is processed by a microcomputer to provide electronic commands to solenoid control circuitry.

In the particular test air varying apparatus for a can inspection machine described in the preferred embodiment an encoder device is mounted on a rotating element of the can inspection machine which provides a digital pulse train to a frequency to current converter. The frequency to current converter measures the pulse train against an internal clock circuit and generates a variable strength control current output in response thereto. The control current is provided to a current to pneumatic converter which receives control air from a low pressure air supply line and discharges control air at a pressure proportional to the strength of the electric control current to actuate a pneumatic control valve.

The pneumatic control valve is connected to a high pressure air supply source and discharges system air used to pressurize can body members and form light tight seals. The discharge pressure from the pneumatic control valve is dependent on the control air pressure and is indicated on an output gauge. The current to pneumatic converter is provided with manually adjustable ratio relay pneumatic circuitry whereby the control air may be proportionally boosted. The boost air may be supplied from the high pressure air source. The system may thus be calibrated to a desired control valve outlet pressure range by manual adjustment of the ratio relay. In one embodiment the various control devices are constructed such that the outlet pressure of the control valve varies linearly with the speed of the machine. This has been found to produce a substantially constant pressure within the can body and at the seal interface at the end of each pressurization cycle over a very broad operating speed range.

A linear machine speed to pressure relationship has been found to be a sufficiently close approximation to the optimum speed to pressure relationship to allow proper functioning of can detective machines of the type described in McMillan et. al. within the present limits of technology. Using such variable air pressure apparatus, the effective dynamic range of such can detection machines can be increased from a previous range on the order of 600 to 1200 cans per minute to a range of 0 to 1800 cans per minute or greater. However, as the state of the art improves, the linear speed to pressure relationship may become sufficiently divergent with the optimum relationship to require the use of a more precise mathematical model and the use of such a model may be implemented by the use of a microprocessor or other control circuitry.

It is among the objects of the present invention to provide a high speed machine for continuous testing of can body members for defects which is operable over a broad dynamic range. It is a further object of the invention to provide apparatus for varying the pressure of system air used to form light tight seals and to pressurize can body members as a function of the machine operating speed. It is another object of the invention to provide such a machine which is operational over a broad dynamic range without an increase in scrap or an increase in damage to sealing apparatus. It is a further object of the invention to increase the overall operating effectiveness of high speed can body inspection machines.

BRIEF DESCRIPTION OF THE DRAWING

The inventive concepts are illustrated in apparatus comprising a presently preferred embodiment thereof on the accompanying drawing in which:

FIG. 8 is an enlarged cross-sectional view of a portion of the apparatus of FIG. 4 enclosed by the dashed line 8—8 prior to sealing association of the can body member with a sealing means;

FIG. 10 is an enlarged end view of a portion of the apparatus taken along the line 10—10 in FIG. 6;

DETAILED DESCRIPTION IN GENERAL

Figure 9:
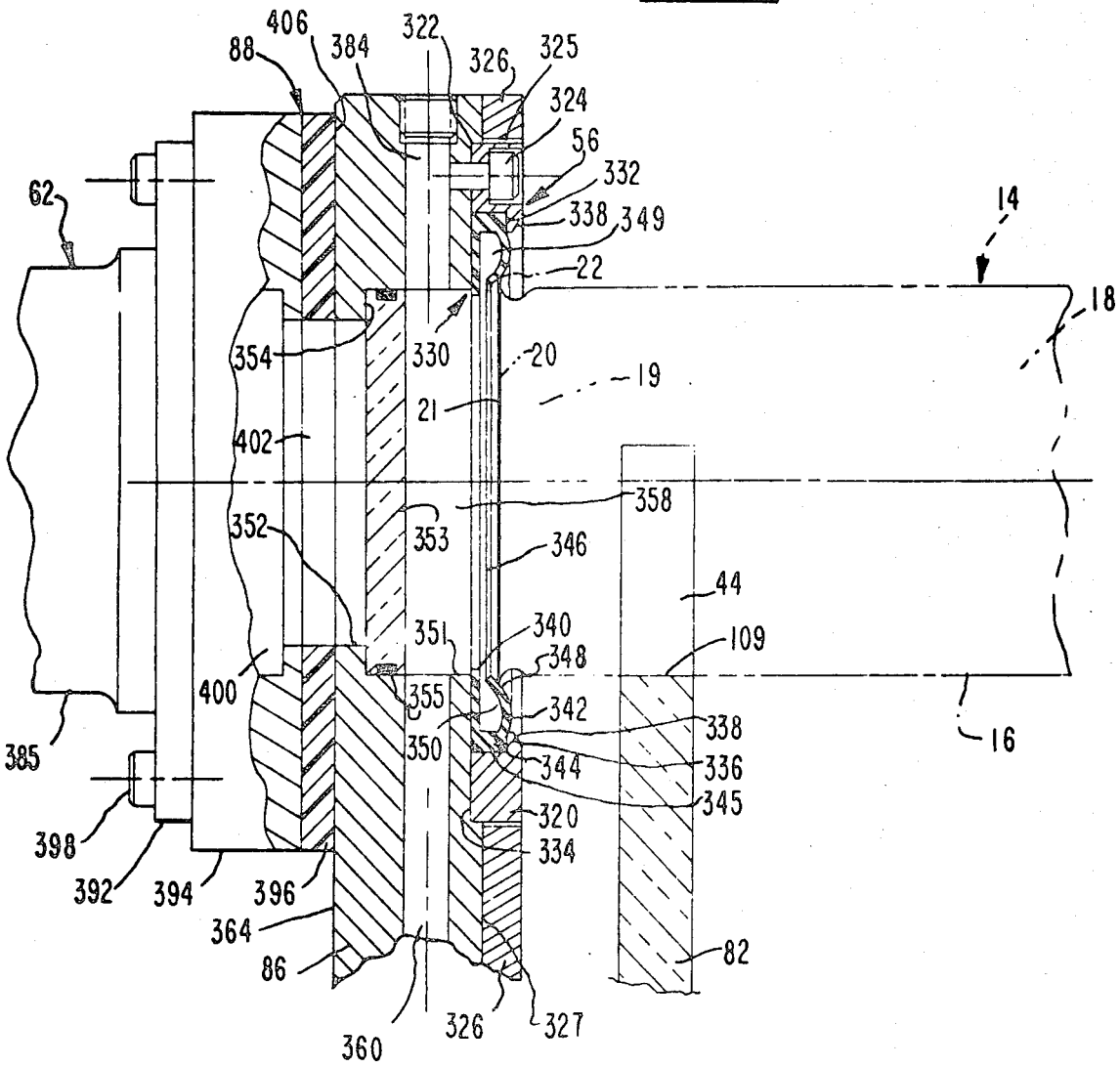
FIG. 9 is an enlarged cross-sectional view of the portion of the apparatus of FIG. 4 enclosed by the dashed line 8—8 after sealing association of the can body member with the sealing means.

While certain of the inventive concepts are applicable to high speed production machines generally, the embodiment of the present invention illustrated in the drawing is particularly adapted for variable speed testing of one piece aluminum can body members 14 utilized for manufacture of two piece metal cans. As shown in FIGS. 8 and 9, such one piece metal can body members comprise an annular sidewall portion 16, closed at one end by an inwardly domed concave bottom wall portion 17 to define a container cavity 18, while having an annular opening 19 at the opposite end surrounded and defined by a formed generally radially outwardly extending annular flange portion 20 having a generally radially extending outer side surface 21 terminating in an annular edge portion 22. Such can body members are conventionally utilized to package beer, soft drinks, and other products by filling the container cavity 18 with the product and then sealingly attaching an end closure member over the opening 19 in sealed association with the flange portion 20 which is further deformed during the attachment process to effect a sealed relationship with the end member. In addition, the outer peripheral surface of sidewall portion 16 conventionally has a label of printed ink applied thereto.

It is desirable to inspect such can body members for "defects" prior to filling the can body member with the product to be packaged therein and prior to associating the end closure member therewith. Among the various "defects" in the can body member which should be preferably detected before filling and closing are: (1) any pin holes which will prevent complete sealing of the contents; (2) any cracks or deformation in the flange portion 20 which will prevent proper sealed association with the end closure member; (3) any dents or deformation in the sidewall portion 16 which may affect the round annular conditions of the flange portion 20 and, hence, prevent proper sealed association with the end closure member or the appearance of the finished filler container; and (4) the absence of a printed ink label on the outer peripheral surface of the sidewall portion 16.

Figure 1:
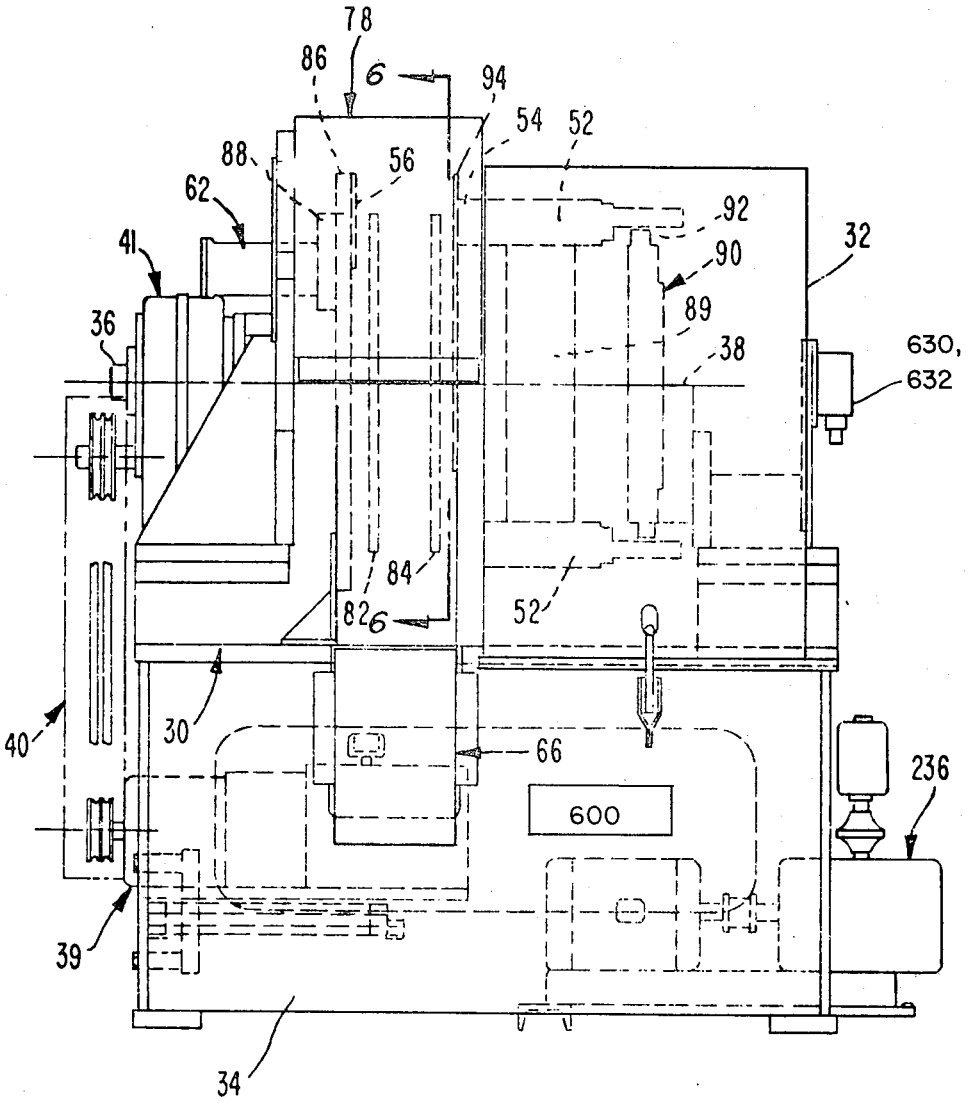
FIG. 1 is a side elevation view of the apparatus.
Figure 3:
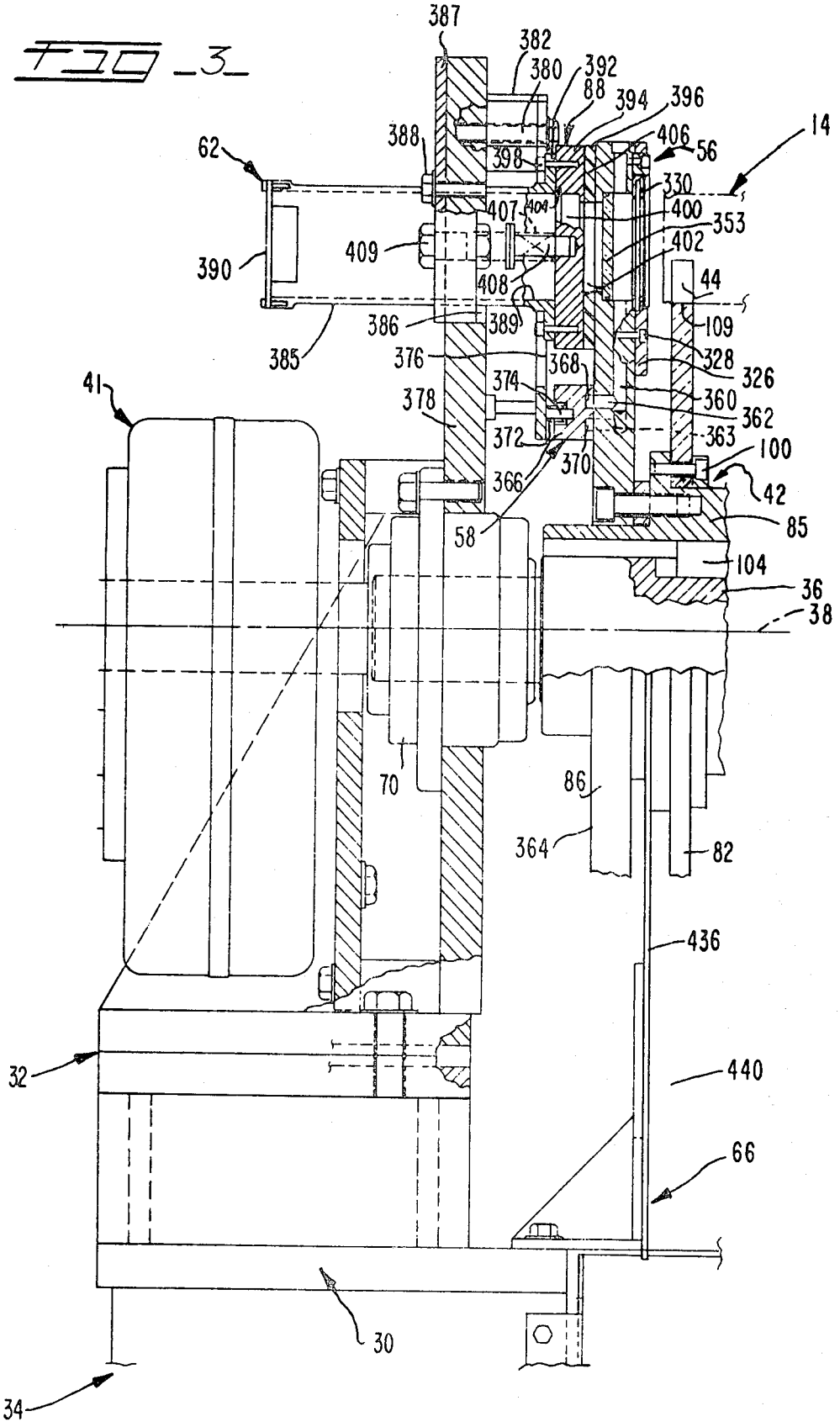
FIG. 3 is an enlarged partial cross-sectional side elevational view of the lefthand portion of the apparatus of FIG. 1 taken along line 3—3 in FIG. 2.
Figure 6:
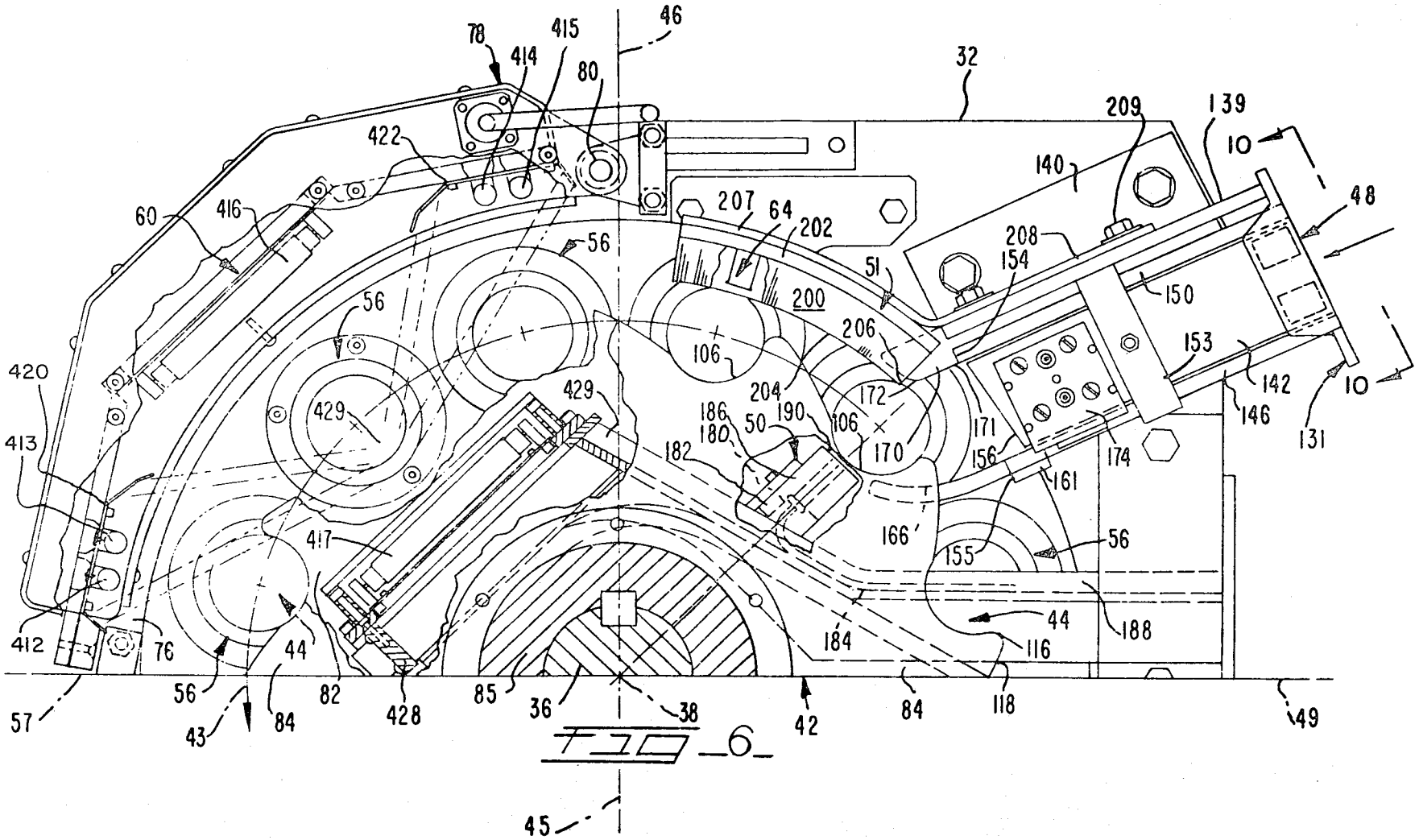
FIGS. 6 and 7 are enlarged partial cross-sectional views, with parts removed, taken along the line 6—6 in FIG. 1.
Figure 7:
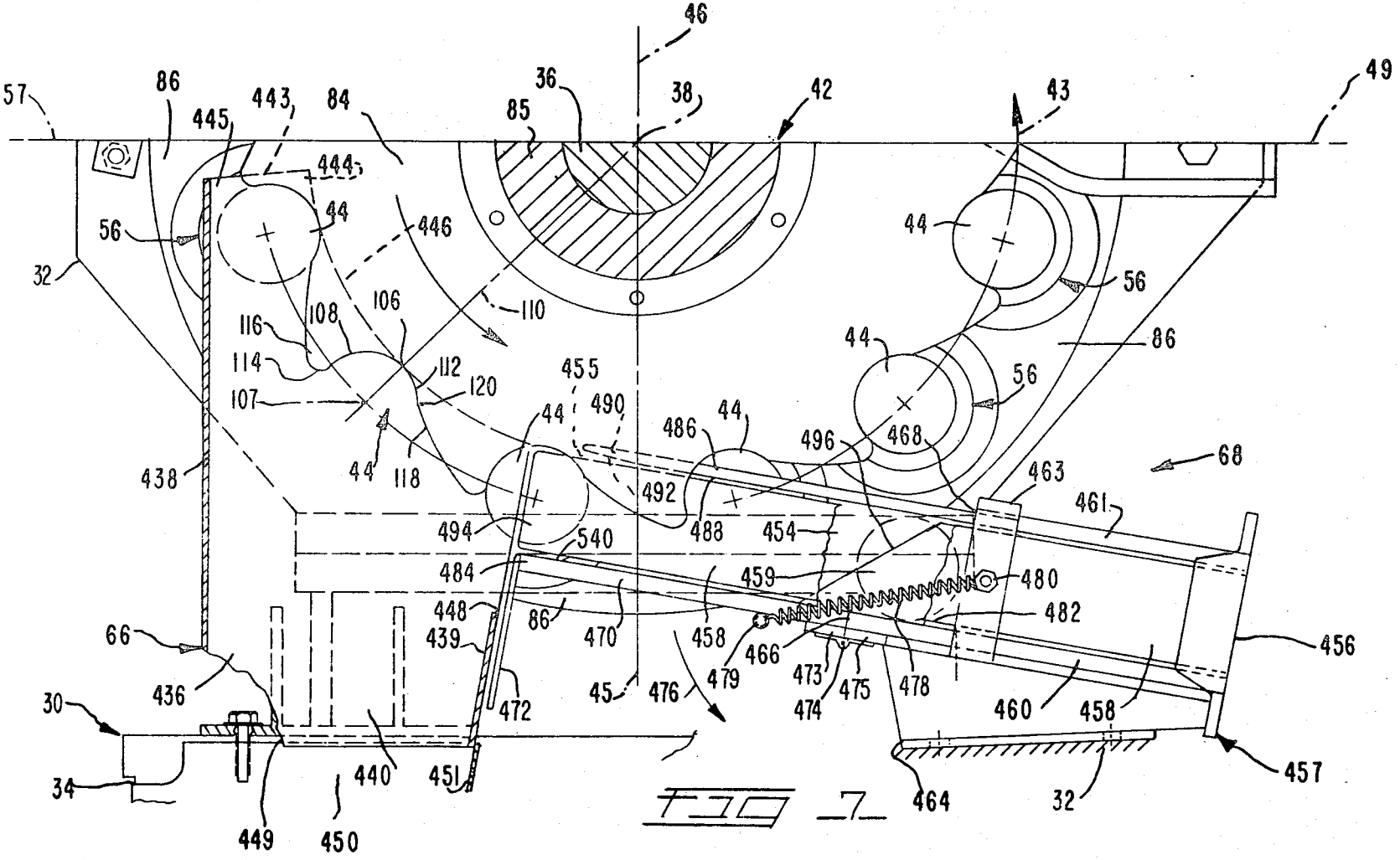
Figure 14:
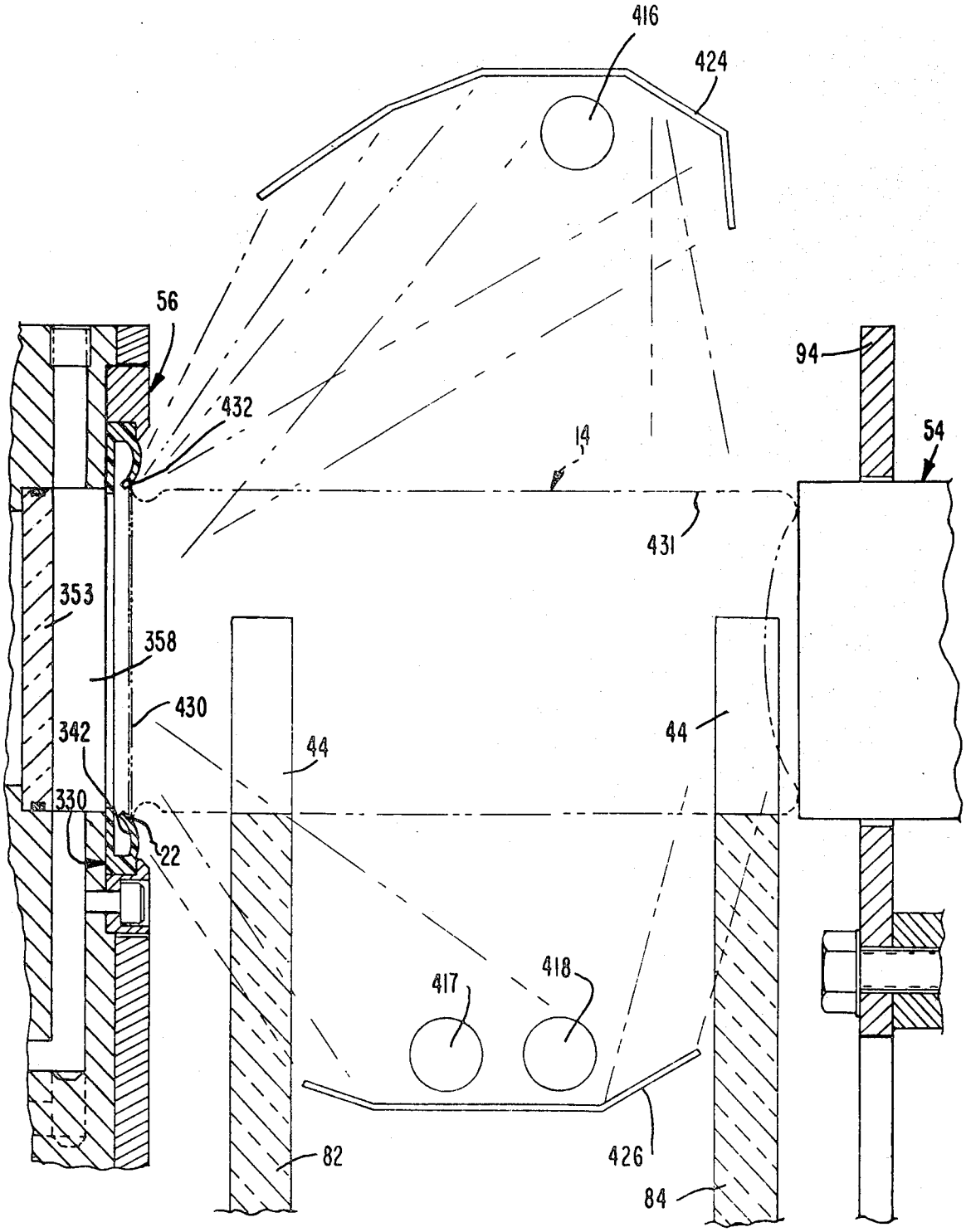
FIG. 14 is an enlarged cross-sectional view of a portion of the apparatus of FIG. 6.
Figure 15:
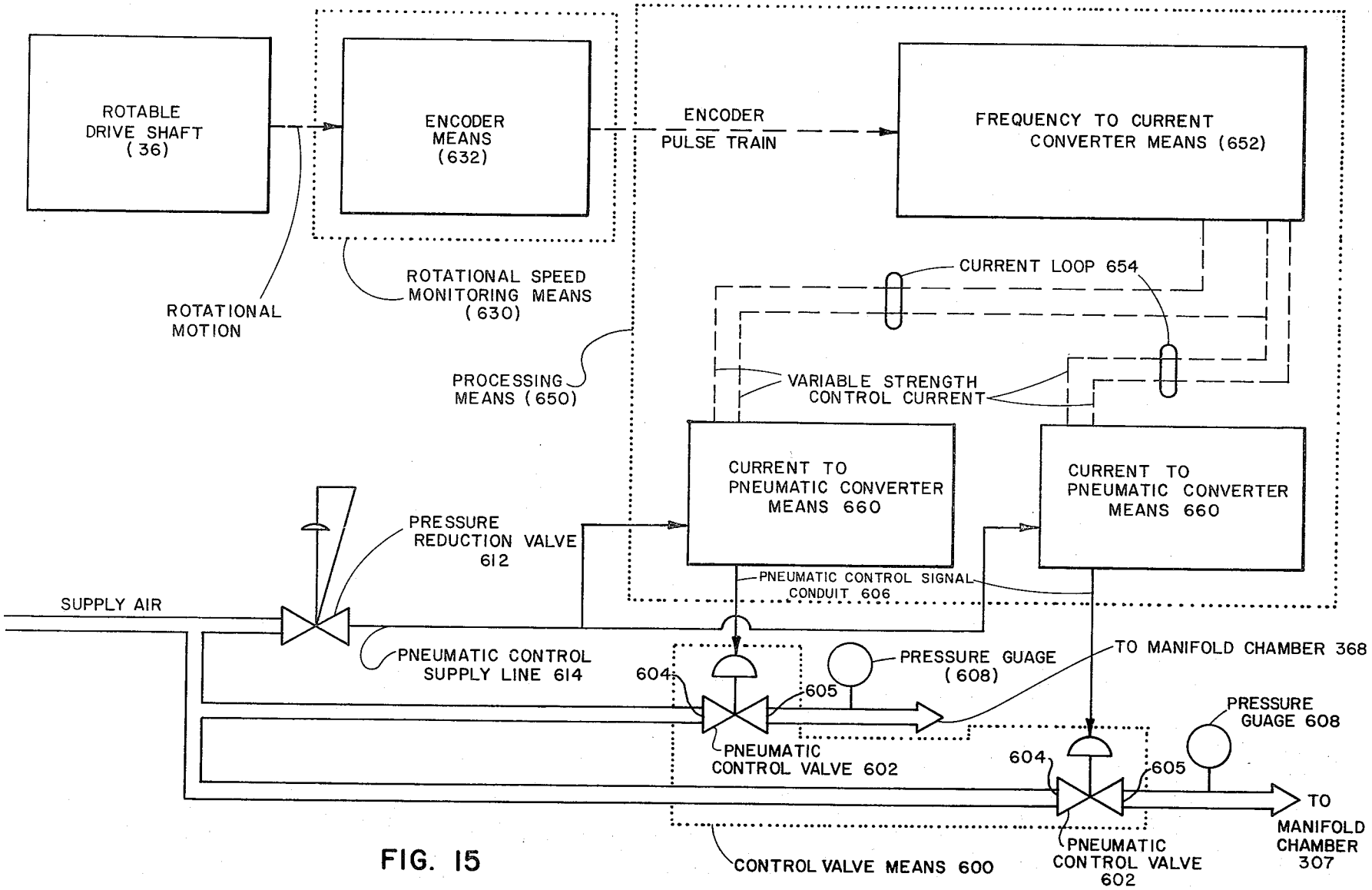
FIG. 15 is a schematic drawing of the air pressure control system of the apparatus.

In general, the presently preferred embodiment of the invention shown in the accompanying drawing comprises: frame and housing means 30 having upper and lower portions 32, 34 for the machine components; horizontally extending rotatable drive shaft means 36 for continuous rotation of various machine components about a central axis of rotation 38; electric motor means 39, belt-pulley drive means 40, and speed reducer means 41 for causing continuous rotation of the rotatable shaft means; can body member transfer wheel means 42 mounted on the rotatable shaft means for continuous rotation therewith and for carrying can body members in a circular path 43, FIGS. 6 and 7, in the direction of the arrows thereabout; a plurality of pocket means 44 circumferentially spaced about the outer periphery of said transfer wheel means for receiving a can body member 14 and supporting the can body member sidewall portion 16 in each pocket means, there being twelve axially spaced pairs of such pocket means in the illustrative embodiment, and for transferring each can body member along the circular path of movement only during a portion of each revolution of the transfer wheel means with each pocket means being carried generally upwardly between lower vertical centerline 45 and upper vertical centerline 46 during 180° of each revolution and generally downwardly during the other 180° of each revolution of the transfer wheel means; infeed means 48 non-rotatably mounted on the frame and housing means for loading one can body member in each of the pocket means during the last 90° of the generally upward movement of the pocket means between horizontal centerline 49 and upper vertical centerline 46 during each revolution; empty pocket detection means 50, FIG. 6, for providing a control signal whenever no can is placed in the pocket means 44 at the infeed means 48; non-rotatable seating means 51, mounted in juxtaposition to the infeed means for seating each can body member on a surface of each of the pocket means during the last 90° of the generally upward movement of the pocket means between centerlines 49, 46 during each revolution; extendable and retractable means 52, FIG. 1, mounted on the drive shaft means for rotation therewith, there being one such means for each of the pocket means, and for axially moving each can body member in each of the pocket means between a first axially retracted position and a second axially extended position during each revolution; releasable holding means 54 associated with each of the axially extendable and retractable means for abutting and releasable holding engagement with the bottom wall portion of each can body member in each of the pocket means during predetermined portions of each revolution; flange portion sealing means 56 associated with each of the axially extendable and retractable means and each of the pocket means and being mounted on the drive shaft means for rotation therewith and for sealable engagement with the flange portion 20 of each can body member carried in each of the pocket means during the first 90° of the generally downward movement of the pocket means between upper vertical centerline 46 and horizontal centerline 57, FIG. 6, during each revolution; pressurization means 58, FIG. 3, associated with each of the sealing means for applying pressurized air to the sealing means for obtaining a minimum area of sealable engagement between the sealing means and the flange portion 20 of each can body member and for applying pressurized air through the can body member opening 19 to the container cavity 18 to apply outwardly directed force on the interior surfaces of the can body member to outwardly flex the sidewall portion 16 and the bottom wall portion 17 to enhance the detection of pin holes by passage of light therethrough; control valve means 600, FIGS. 1, 15 operably associated with said pressure means for varying the pressure of the pressurized air applied to the sealing means and can body member; rotational speed monitoring means 630 FIGS. 1, 15 for monitoring the speed of said rotatable shaft means and generating a monitoring signal in response thereto; processing means 650 FIG. 15 for receiving and processing said speed monitor signal and providing a processed control signal in response thereto for actuating said control valve means for providing pressurized air at a pressure that varies with the speed of the machine; non-rotatable light applying means 60, FIGS. 6, 14 for applying light to the exterior surfaces of each pressurized can body member in each of the pocket means in sealable association with the sealing means and being located to provide a continuous light zone during the first 90° of the generally downward movement of the pocket means during each revolution; light detection means 62, FIG. 1, non-rotatably mounted relative to the transfer wheel means and the sealing means and being located for successive axial alignment with each of the pocket means, after sealable association of the flange portion with the sealing means and pressurization of the sealing means and the can body member carried in the pocket means, in the light zone for receiving light only from the light applying means through the can body member and/or between the flange portion and the sealing means, and for generating a first defective can control signal upon receipt of light to provide an indication of a defective can body member; non-printed can body member detection means 64, FIG. 6, non-rotatably mounted relative to the transfer wheel means and located in juxtaposition to the seating means and adjacent the outer peripheral surface of the sidewall portion 16 of each can body member while being carried by the pocket means along the circular path for providing a second defective can control signal in response to light reflected from the outer peripheral surface of non-printed can body members; defective can body member discharge chute means 66, FIG. 7, for receiving defective can body members from the pocket means on the transfer wheel means during only the last 90° of the generally downward movement of the pocket means between horizontal centerline 57 and lower vertical centerline 45 during each revolution; and non-defective can body member unloading chute means 68, FIG. 7, for receiving non-defective can body members from the pocket means on the transfer wheel means during only the last part of the last 90° of the generally downward movement of the pocket means during each revolution.

Figure 2:
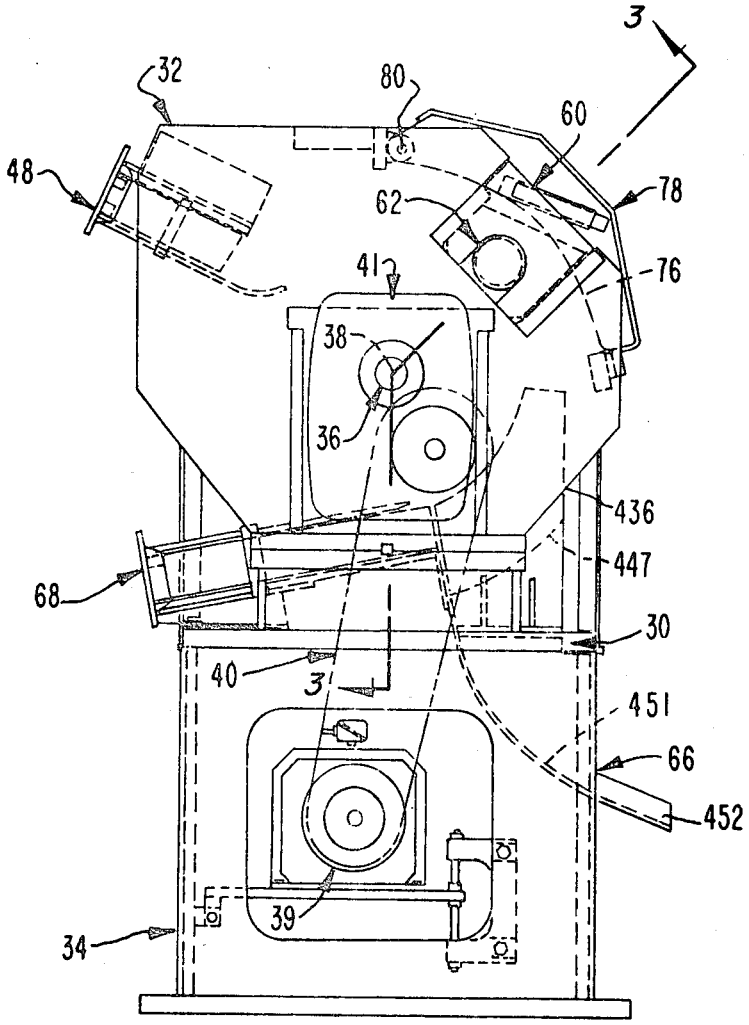
FIG. 2 is an end view of the apparatus of FIG. 1.

Referring now to FIGS. 1 and 2, in general, the test apparatus is mounted in relatively compact frame and housing means 30 comprising a lower motor and control housing portion 34 and an upper test apparatus portion 32. In the illustrative embodiment the housing means has a height of 51 inches, a length of 46 inches, and a width of 29 inches. The conventional electric motor-transmission means 39 is drivably connected by the conventional belt-pulley means 40, and the conventional speed reducer box 41 to the central axially extending shaft means 36 rotatably supported by suitable bearing means 70, 72, FIGS. 3–5.

The rotatable can body member transfer wheel means 42 is fixedly mounted on a central portion of shaft means 36 for continuous rotation therewith in a closed or partially closed generally annular test chamber 74 having an access opening 76, FIG. 3, closable by a light sealing door means 78 pivotally mounted at 80, FIG. 2.

The transfer wheel means 42 comprises a pair of axially spaced annular transparent plate members 82, 84 on which the plurality of peripheral circumferentially spaced and coaxially aligned can body receiving pocket means 44, FIGS. 6 and 7, are provided. A hub member 85 fixedly mounts the plate members 82, 84 on shaft means 36 for continuous rotation therewith.

The sealing means 56 are rotatably carried by an annular sealing wheel means 86, and peripherally mounted thereon in circumferentially spaced coaxially aligned relationship with pockets 44. Wheel means 86 is fixedly mounted on shaft means 36 by hub member 85 for continuous rotation therewith and located in axially spaced relationship to transfer wheel member 82.

The light detector means 62 is fixedly mounted on the side wall of chamber 74 and extends axially into chamber 74 with a sealing head means portion 88 coaxially alignable with sealing means 56 and mounted in sealed engagement with the adjacent side surface of sealing wheel means 86.

Figure 5:
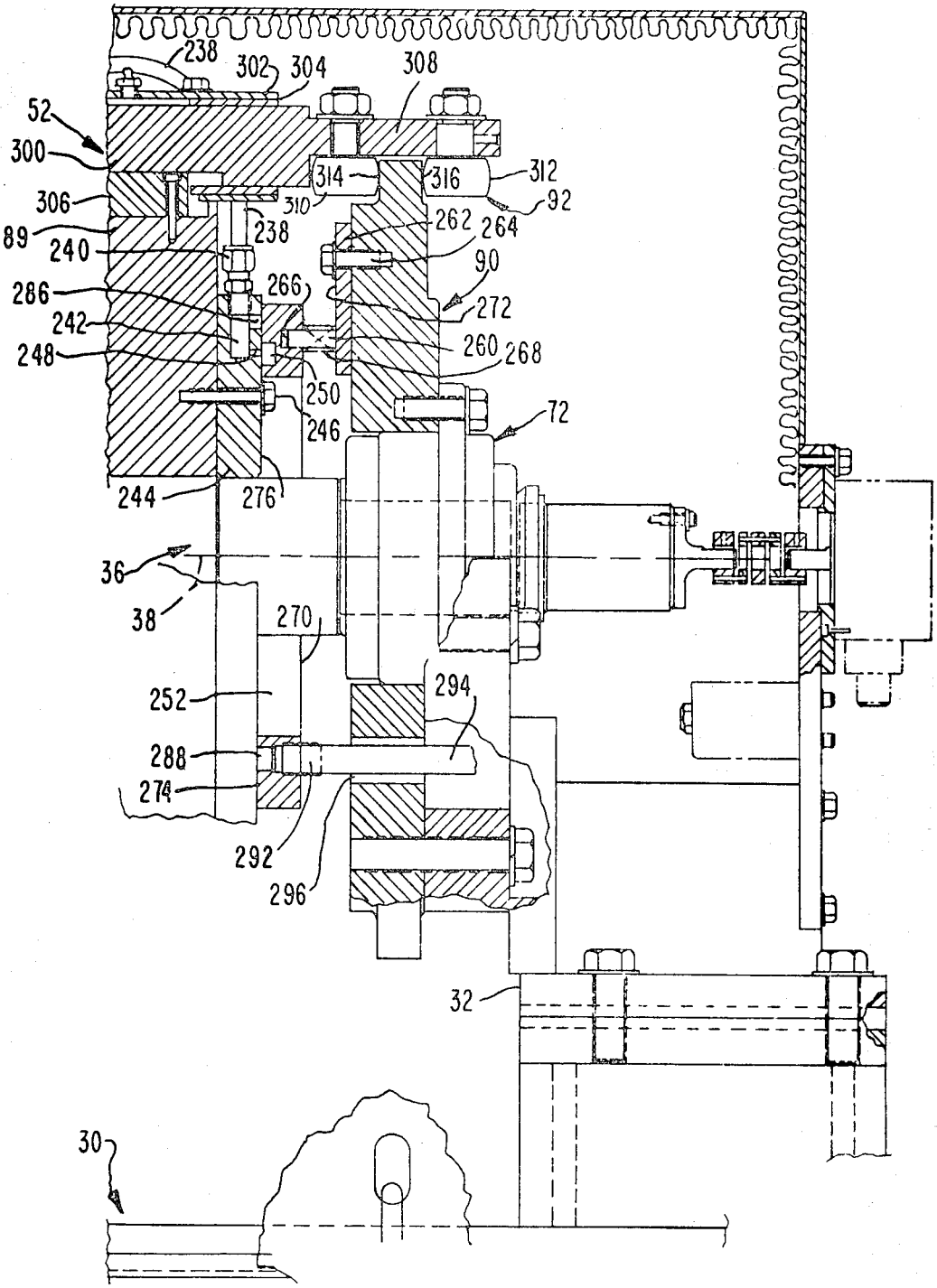
FIG. 5 is an enlarged partial cross-sectional view of the right hand portion of the apparatus of FIG. 1 axially next adjacent the apparatus shown in FIG. 4.

The releasable holding means 54 are coaxially mounted on the ends of the extendable and retractable means 52 in circumferentially spaced and coaxial alignment with pockets 44. The releasable holding means 54 and extendable and retractable means 52 are fixedly mounted on shaft means 36 by a hub member 89 for continuous rotation therewith in axially spaced relationship to transfer wheel member 84. A cam plate means 90, FIG. 5, is fixedly mounted relative to shaft means 36 for caming engagement with cam follower means 92 to extend and retract means 52. A can body member guide plate means 94 is fixedly mounted on hub member 89 for continuous rotation with shaft means 36 and has a plurality of circumferentially spaced openings 96, FIG. 8, coaxially aligned with holding means 54 to enable axial movement of the holding means therethrough.

RELEASABLE HOLDING MEANS

Figure 4:
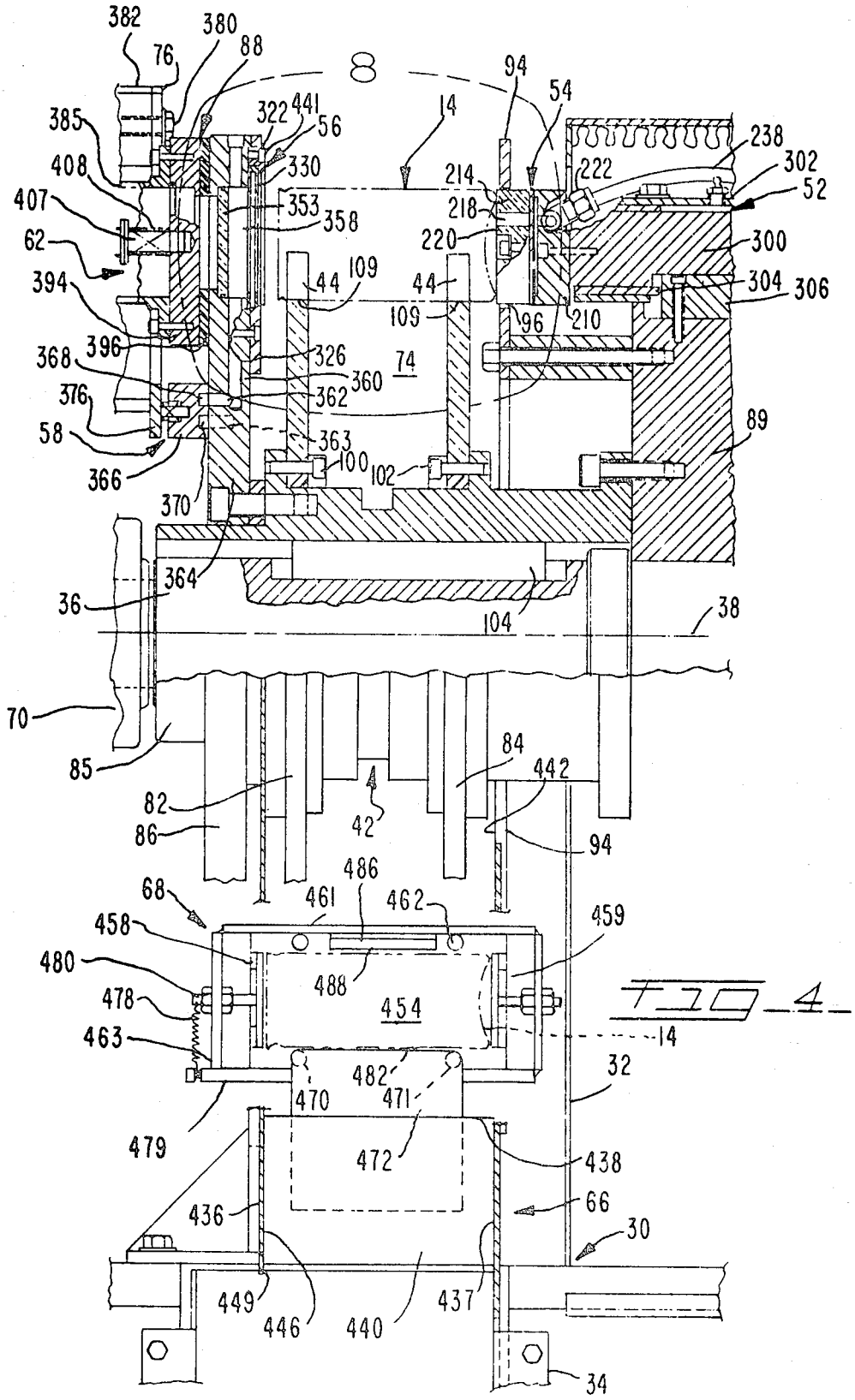
FIG. 4 is an enlarged partial cross-sectional side elevational view of an intermediate portion of the apparatus of FIG. 1 axially next adjacent the apparatus shown in FIG. 3.

Referring now to FIGS. 4 and 8, the releasable holding means 54 comprise twelve separate equally circumferentially spaced axially extendable and retractable units which are rotatable with wheel members 82, 84 in general axial alignment with pockets 44. Each unit comprises an annular mounting block member 210, a spacer member 212, and an annular transparent support plate member 214 attached to member 210 by suitable recessed fastening means 216. A vacuum and air passage 218 extends axially through flat front end surface 220 and is connected to vacuum supply coupling 222 through a passage 224 and a chamber 226 without use of a flap valve to control vacuum conditions as described in U.S. Pat. No. 3,370,877. The arrangement, as hereinafter described in further detail, being such that, as shown in FIG. 8, the bottom end wall portion 17 of a can body member 14 is held against the surface 220 of plate member 214 with abutting substantially sealing engagement established along the annular rim portion 230 of the can body member to provide a vacuum chamber 234, between surface 220 and the inwardly domed bottom end wall portion 17 connectable to a vacuum source through passage 218.

The passages 218, 224, and chamber 226 are connectable to a conventional vacuum source, such as a vacuum pump and control assembly 236, FIG. 1, at predetermined times during each revolution, through coupling 222, a flexible hose 238, a coupling 240, FIG. 5, a radially extending passage 242 in an annular connecting plate 244 fixed to hub member 89 by suitable fastening members 246 for rotation therewith, an axially extending passage 248, and an arcuate vacuum supply chamber 250 in a non-rotating manifold ring member 252 which is connected to the vacuum source in a manner to be hereinafter described. Pin members 260 are fixedly mounted on an annular ring plate member 262, fixedly non-rotatably mounted on plate member 90 by suitable fastening elements 264, and are loosely received in axially aligned bores 266 in manifold ring member 252 to retain the ring member 252 in non-rotational relationship relative to rotating connecting plate member 244. The bores 266 are larger than the pin members 260 to enable relative axial sliding movement therebetween so that compression spring members 268, mounted circumjacent pin members 260 between axially spaced side surfaces 270, 272, are effective to axially bias the smooth polished side surface 274 of manifold ring member 252 into abutting sealing engagement with the smooth polished side surface 276 of connecting plate member 244.

Figure 11:
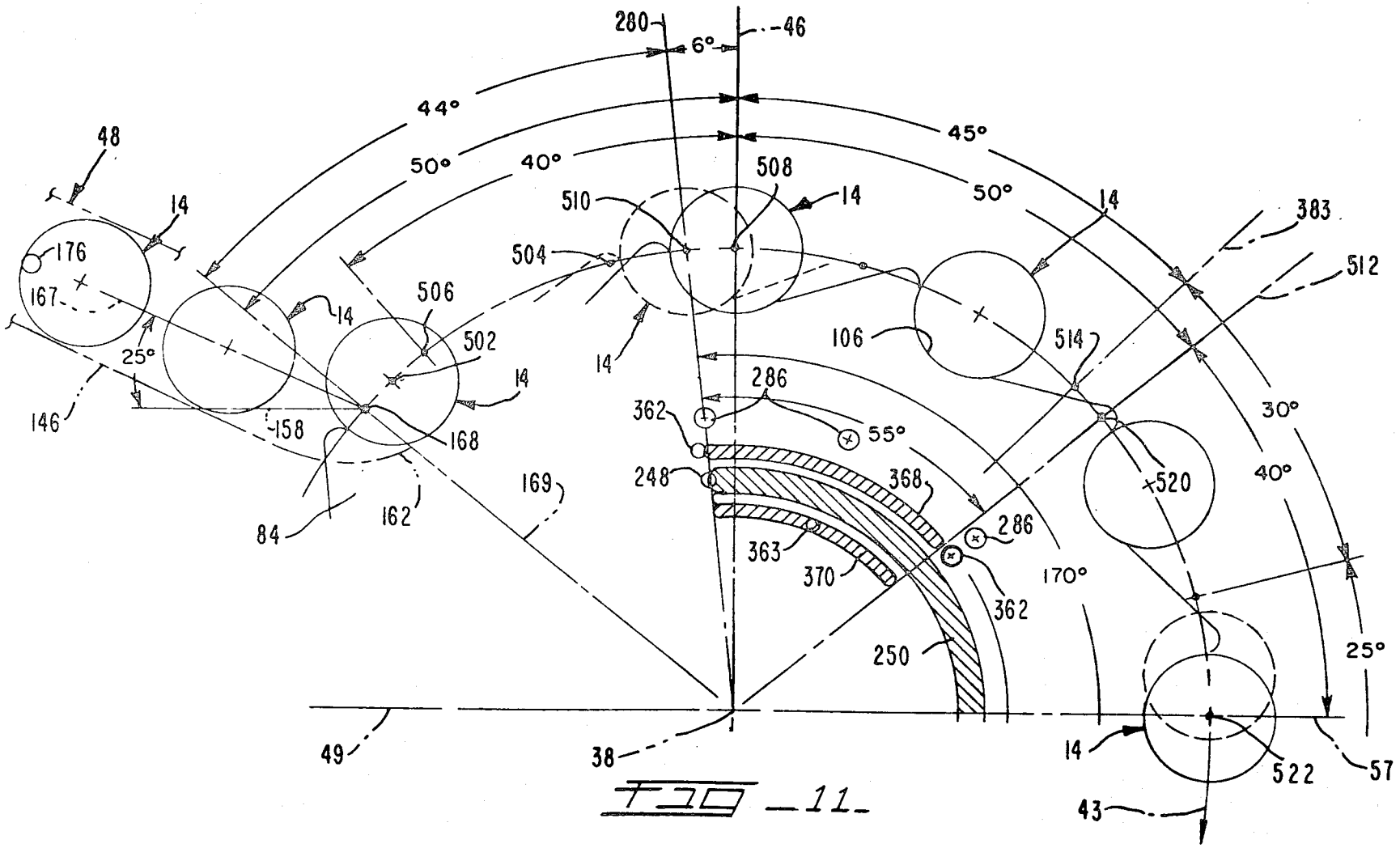
FIGS. 11 and 12 are enlarged schematic representations of portions of the apparatus illustrating the sequence of operation thereof.
Figure 12:
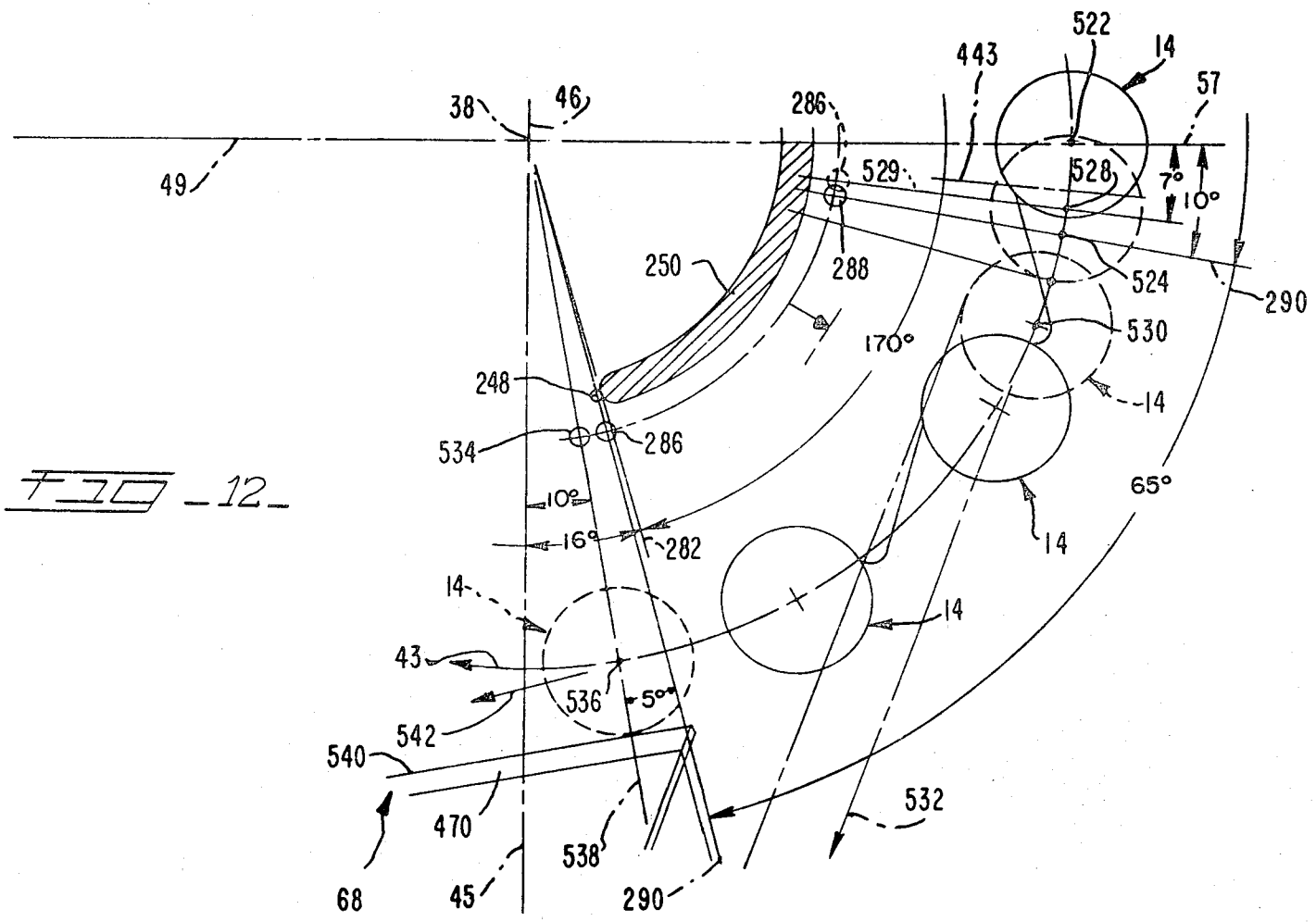

Referring now to FIGS. 11 and 12, each of the passages 218 of FIG. 4 in each of the support head plates 214 is abutting substantially sealing engagement established along connectable, at predetermined locations during each revolution, when the associated passage 248 in connecting ring member 244 becomes aligned with the arcuate vacuum chamber 250 which extends arcuately circumferentially approximately 170° in manifold plate member 252 from approximately 6° (at radial line 280) before upper vertical centerline 46 to approximately 16° (at radial line 282) before lower vertical centerline 45. The vacuum chamber 250 is continuously connected to the vacuum source 236 by a fixedly mounted coupling and a flexible conduit (not shown) extending axially through an axially extending bore in plate member 90 in a manner to be hereinafter described in reference to pressurized air supply means.

The passages 218, 224, 228 are also connectable to a conventional source of pressurized air (not shown) through coupling 222, flexible hose 238, coupling 240, radially extending passage 242, and an axially extending passage 286 which is connectable, at predetermined times during each revolution, to a second axially extending air passage 288 located in non-rotating manifold ring 252 approximately 75° (at radial line 290) below horizontal centerline 57. Air passage 288 is controllably connected to a conventional source of pressurized air (not shown) through conventional control valve apparatus (not shown) by a separate coupling member 292, FIG. 5, and flexible conduit 294 extending through a bore 296 in non-rotating plate member 90, the vacuum chamber 250 being connected to the vacuum source by a similar arrangement.

SEALING MEANS

Referring now to FIGS. 8 and 9, sealing means 56 comprises twelve circumferentially spaced units mounted on rotatable plate member 86 in coaxial alignment with the pocket means 44 and the holding means 54. As shown in FIG. 9, each sealing head means 56 comprises can body member flange sealing means in the form of an annular mounting ring member 320 suitably fixedly connected to the rotatable plate 86 within an annular counterbore 322 by suitable fastening elements 324 and within an annular opening 325 in a ring member 326 mounted on the side surface 327 of member 86 circumjacent mounting ring members 320 by suitable fastening elements 328.

Figure 13:
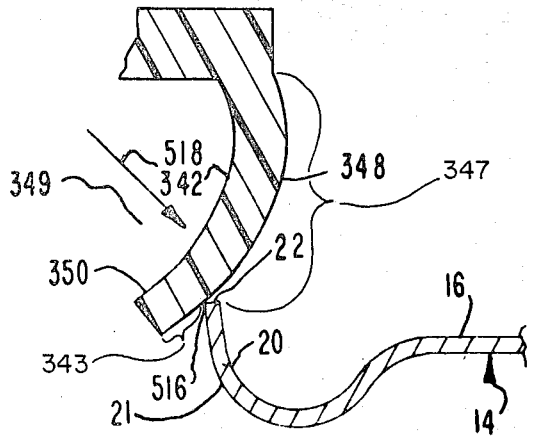
FIG. 13 is an enlarged cross-Sectional view of a portion of the sealing means and a portion of the can body member of FIG. 9.

An annular resilient flexible sealing ring member 330 of the general type disclosed in U.S. Pat. No. 3,672,208 is fixedly mounted between surface 332 of ring member 320 and surface 334 of plate member 86. Ring member 320 has a radially inwardly extending flange portion 336 with an inwardly tapered front surface 338. Ring member 330, which is made of suitable resilient molded plastic material, such as Neoprene or Urethane or the like, has a U-shaped cross-sectional configuration including first and second identical radially inwardly extending axially spaced annular flange portions 340, 342 connected by axially extending rim portion 344 so as to be reversible. The rim portion 344 is abuttingly sealingly received on annular surface 345 of member 320. The side surface of the inner flange portion is abuttingly received on surface 334 of member 86. The outer flange portion 342 freely extends generally radially inwardly from rim portion 344 for resilient flexible displacement relative thereto. Flange portions 340, 342 extend radially inwardly substantially beyond the annular outer edge portion 22 of the can body members supported in pockets 44 and terminate in an annular lip portion 346 having a diameter less than the outside diameter of the can body member rim portion 22. Thus, the outer side surface 348 of the outer flange portion 342 is engageable with the outer edge 22 of the flange portion along a relatively small width annular overlapping portion 343 of the outer surface 348 of portion 342, FIG. 13. The arrangement is such as to effect sealing engagement therebetween by substantially line contact when the flange portion of the can body member is in engagement therewith. As shown in FIG. 9 and 13 during sealing engagement with the rim portion 22, the flange portion 342 is resiliently flexible outwardly bowed so that a balloon portion 347 of the outer side surface 348 has a curvature to further assure the desired sealing engagement by substantially line contact. A pressurization chamber 349 is defined by the flange portions 340, 342 and rim portion 344 whereby pressurized air in chamber 349 may be applied to the inner surface 350 of the outer flange portion 342 to further control and obtain the desired sealing engagement with the can body rim portion 22. Although differing dimensional parameters and resiliency characteristics will provide varying degrees of sealing efficiency at different internal can pressure settings, it has been discovered that a highly efficient sealing operation is provided with minimal sealing ring damage and wear when the annular overlapping portion radially extending width measured along the outer surface 348 of portion 342 lies within a range between 0.160 inches and 0.250 inches for a sealing ring material having a durometer of between 65 A and 75 A and having an outer flange portion 342 thickness of between 0.040 inches and 0.080 inches. Within these overlap dimensions and durometers a light tight seal may be formed with an internal can body member air pressure of between 7 and 15 psig. Similarly a balloon portion 347 surface dimension of between 0.180 inches and 0.350 inches has been found to be important in producing an adequate seal in association with the above described parameters. It has been found that sealing rings having such dimensional characteristics are operational over a wide range of machine speeds—from 0 to 1800 cans per minute or more.

PRESSURIZATION MEANS

In order to supply pressurized air to the inside 18 of the can body member and to the chamber 349 of the sealing ring member 330 as well as permit passage of light to the light detection means 62, counterbores 351, 352 extend through plate member 86 in coaxial alignment with pockets 44 and sealing means 56. An annular plate 353 of transparent material, such as Plexiglas or the like, is fixed in bore 351 against a shoulder 354 and sealably mounted therein by an O-ring peripheral sealing member 355 to define a chamber 358 to receive pressurized air from a radially extending passage 360 and to enable the passage of light therethrough from chamber 358 to bore 352. With a can body member mounted on the releasable holding means 54 and with shaft member 300 extended to engage the rim portion 22 of the can body member with the sealing lip portion 342, a closed pressure chamber means is defined by the transparent annular plate 353, bore portion 351, the sealing ring means 330, and the can body member 14.

In order to pressurize the pressure chamber means at predetermined times, each bore portion 351 is connectable by a radially inwardly extending passage 360 in member 86 to an axially extending passage 362 or 363, FIGS. 3 and 11, in member 86, which open through side surface 364. A manifold arcuate segment member 366, FIG. 3, having two radially offset circumferentially extending arcuate pressure chambers 368, 370, is held in sealing abutting engagement on surface 364 by spring means 372 mounted circumjacent retaining pin members 374 carried by a non-rotatable support plate 376 fixed to another non-rotatable support plate member 378 by suitable fastening elements 380 and spacer elements 382. The arrangement is such that alternate ones of the pressure chamber means 358 are connected to pressure chambers 368, 370 by varying the length of alternate passages 360 and the radial location of alternate passages 362 and 363 as illustrated in FIG. 11. In this manner, a source of air pressure (not shown) adjustably controlled by control valve means 600, FIG. 1, 15, discussed in detail hereinafter is connected by suitable passage means (not shown) to manifold chambers 368, 370 and at predetermined times passages 362, 363 are aligned with chambers 368, 370 to deliver air pressure to the pressure chamber means for purposes to be hereinafter described. In addition, at predetermined times, the passages 362, 363 are located in circumferentially spaced relationship to the manifold member 366, which is in the form of an arcuate segment, whereat the pressure chamber means is vented to the atmosphere. As shown in FIG. 11, chambers 368, 370 extend circumferentially approximately 55° from a position, represented by radial line 280 prior to the upper vertical centerline 46 to a position slightly beyond the test station represented by radial line 383. It is noted that a portion 384 of axial passage 360 is extended radially outwardly beyond chamber 358 for manufacturing purposes and is suitably sealed as by a threaded closure.

AIR PRESSURE CONTROL SYSTEM

As illustrated schematically by FIG. 15, the rotatable drive shaft 36 is operably attached to a rotational speed monitoring means 630 which receives rotational motion input from the rotatable drive shaft 36 and generates a monitoring signal in response thereto. The monitoring signal is received as input to a processing means 650 which converts it to a control signal for actuating control valve means 600.

In one preferred embodiment of the invention the rotational speed monitoring means 630 comprises an encoder means 632 as illustrated in FIG. 1 conventionally mounted on the rotatable drive shaft 36 as by shaft coupling means (not shown) or conventional pulley and drive belt assembly (not shown). The encoder 632 generates a pulse train, the frequency of which is linearly dependent upon the rotational speed of the rotatable drive shaft 36. In the preferred embodiment illustrated in FIG. 15 the pulse train is transmitted to a frequency to current converter 652 which converts the pulse train to a variable strength control signal, which may be current, voltage, or coded signal, passing through loop 654.

Figure 16:
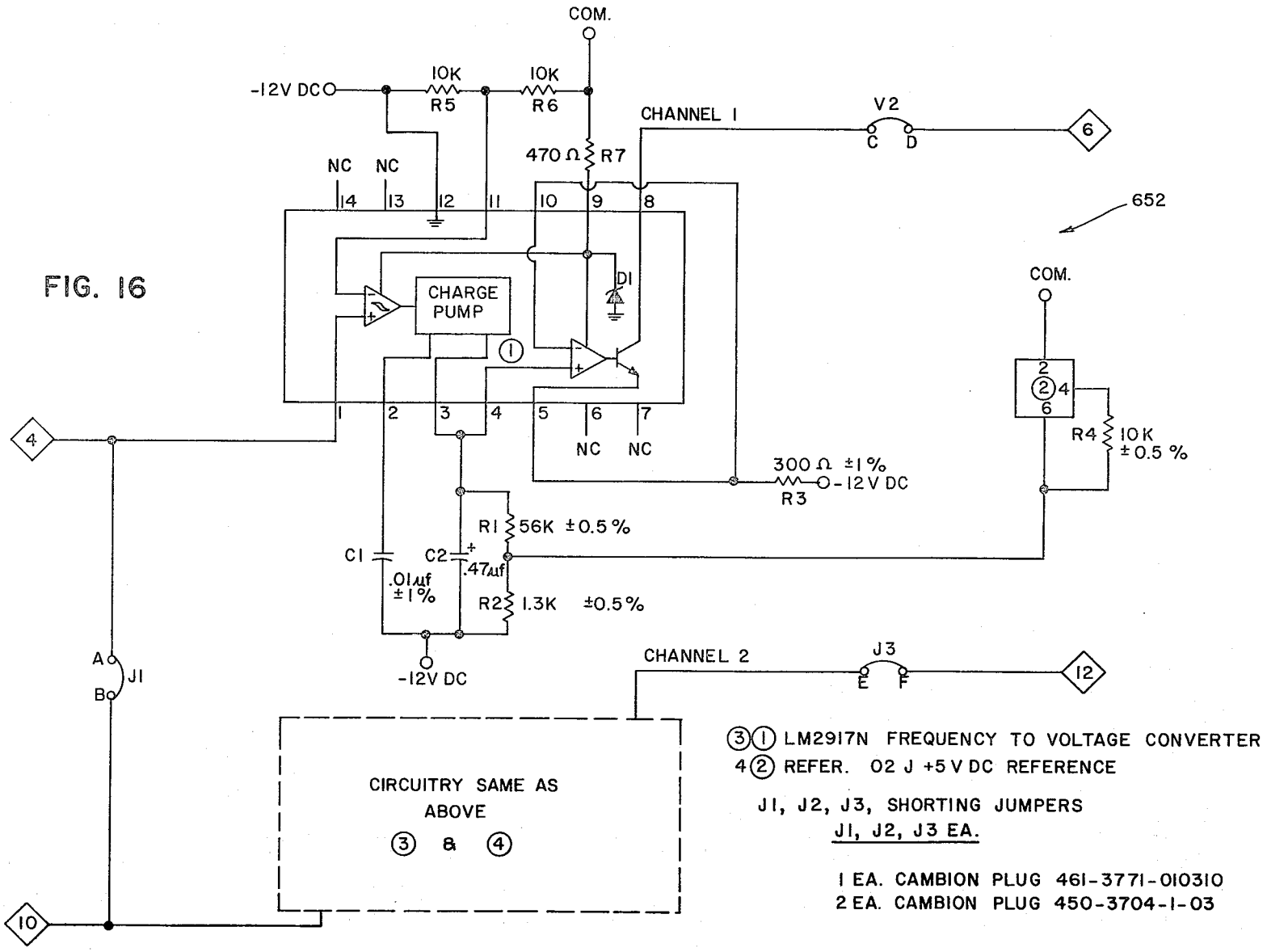
FIG. 16 is a circuit diagram of a frequency to current converter which may be used in the air pressure control system of FIG. 15.

In one preferred embodiment as illustrated in FIG. 16, the pulse train is converted to a variable strength electrical current by a frequency to voltage converter integrated circuit (National Semiconductor LM2917A) wired with appropriate scaling resistors to provide a frequency to current converter 652. The scaling resistors provide for 0–900HZ input=0–1800 cans/min=4-.0–20 ma. An additional offset may be incorporated by means of precision voltage reference to offset the 0 frequency output of 4.0 ma to about 6.0 ma thereby providing the necessary signal to the current to pneumatic converter means 660 (discussed hereinafter) at the control valve discharge orifice 605. The construction of such a frequency to current converter 652 is well known in the art and documented in technical publications such as *National Semiconductor, Linear Applications Handbook* (1980), (*Application Note 172 by Dave Long,* 1976) which is hereby incorporated by reference.

The current loop 654 may be split into as many branches as required which in the preferred embodiment consists of two branches for use in association with the two test air pressure manifold chambers 368, 370. The variable strength control current comprises a current range which in one embodiment is from 4 to 20 milliamps. The control current is converted by a current to pneumatic converter means 660 to a pneumatic control signal which varies in pressure corresponding to the strength of the control current in current loop 654. The current to pneumatic converter means 660 may be of a conventional type well known in the art such as the Fairchild Current to Pneumatic Converter Model No. T-5100 provided with means for adjusting the pressure range and maximum and minimum pressure values in response to a predetermined control current range. For example, the pressure of the pneumatic control signal could be adjusted to vary from 3 to 15 psig for a control current varying between 4 and 20 milliamps. The pneumatic control signal may be transmitted through conventional conduit means 606 to one or more pneumatic control valves 602. The pneumatic control valve 602 may be of a conventional type such as Fairchild Model 21D Adjustable Ratio Relay which is conventionally variable in response to the pneumatic control signal 666, the amount of fluid passing through the control valve 602 being dependent upon the pneumatic control signal pressure. The inlet 604 of the pneumatic control valve is operably connected in fluid communication with a supply source (not shown) which in one embodiment has a pressure of approximately 120 psig. A conventional pressure gauge operably mounted near the discharge orifice 606 monitors the air pressure being discharged from the control valve 602 and allows for proper calibration of the system to a desired pressure operating range which in a preferred embodiment comprises the pressure range illustrated in the graph of FIG. 14 as discussed in further detail herein. In one preferred embodiment the control valve means 600 comprises two pneumatic control valves. Each control valve 602 discharges into one of the manifold chambers 368, 370 which in turn operably pressurize the internal cavity of each can body member and associated seal means. Supply air for the pneumatic control line is provided by the pneumatic control supply line 614 operably connected in fluid communication with the air pressure supply source (not shown) through pressure reduction valve 612. The pressure reduction valve is of a conventional type and provides a constant discharge pressure which may be on the order of 20 psig.

Thus it may be seen that the air pressure provided to pressurize the can body member 14 and seal means 56 is automatically adjusted to predetermine pressure values which vary with respect to the operating speed of the apparatus. In a preferred embodiment the relationship between air pressure and apparatus operating speed is linear.

OPERATION

In the presently preferred embodiment of the aforedescribed apparatus, the infeed chute means 48 is connected to a continuous supply of drawn and ironed aluminum can body members 14 which have a formed flange 20 and which are supposed to have a printed ink label on the exterior peripheral surface of the side wall portion. In normal continuous operation, the solenoid operated pins 176 associated with the infeed chute 48 are withdrawn so that such can body members 14 are stacked in the chute for continuous gravity feed movement therethrough. In the event that it is desired to interrupt the continuous gravity feed of the can body members, the solenoid means 174, 175 may be actuated to extend pins 176 into engagement with the can body member, one pin entering the opening 19 and extending into the interior of an axially aligned can body member in chute passage 130, the pins 176 being located on the chute in a position to be axially aligned with one of the can body members therein.

In continuous operation of the apparatus, the drive shaft means 36 is continuously rotated in the direction of the arrows and causes continuous rotation of the transfer wheel means 42. All loading, testing, and unloading functions are performed during one revolution of the transfer wheel means. The rotational speed of the apparatus is controlled by a conventional speed control unit (not shown) which monitors the number of cans present in associated stacking apparatus (not shown) above the infeed chute 48. The speed control unit varies the rotational speed of the apparatus in a manner to ensure that a sufficient number of cans are available to load each pocket of the apparatus and to increase the speed of operation of the apparatus as more cans become available for loading.

During each revolution, empty pockets 44 are rotated past the infeed means 48 whereat one can body member is gravity loaded into each pair of axially aligned pockets 44 on the transparent plate member 82, 84. As indicated in FIG. 11, the initial loading occurs along radial line 169 at approximately 50° before upper vertical centerline 46. As the can body member is carried further upwardly from the infeed means, the seating means 51 is effective to fully seat and maintain the can body member on arcuate segment surfaces 106 of the pockets. The seating means brushes 200, 201 are initially effective at a first rotational position 502 located at about 45° before upper vertical centerline 46 and substantially fully seat the can body member in the next 5° of generally upward rotation while being continuously effective for about 38° of rotation.

The unprinted can body member detector means 64 is located at a second rotational position 504 at about 30° beyond the first position. The detector means is a self-contained conventional retroreflective photodetector unit having a light source for applying light to the outer peripheral surface of the side wall portion 16 of the can body member and having a light detection means for generating a defective can body member control signal upon reflection of a predetermined level of light from the outer peripheral can body member surface indicative of the absence of a printed ink label thereon. The defective can body member control signal is utilized to subsequently cause discharge of the unprinted can body member into discharge chute means 66 as hereinafter described.

The extendable and retractable means 52, associated with each of the aligned pairs of pockets 44, are initially actuated at a third rotational position 506 about 40° before the upper vertical centerline 46 and are gradually axially, slidably displaced, during approximately the next 40° of generally upward rotation, from the fully retracted position to the fully extended position at about the time of reaching the upper vertical centerline 46. As the means 52 are extended, abutment surface 220 on releasable holding means 54 abuttingly engages the can body member bottom wall portion 17 and axially displaces the can body member relative to the arcuate surface segments 106 of the aligned pockets 44 and relative to the seating means 51 which maintains the can body member on and in slidable engagement with the arcuate segment surfaces 106. The axial movement of the means 52 continues until the flange portion 20 is located in abutting engagement with the flexible sealing lip portion 342 of sealing means 56, as shown in FIG. 9, at approximately the upper vertical centerline rotational portion 508.

When, or preferably slightly before, the can body member has been axially shifted to locate the flange portion 20 in engagement with the flexible sealing lip portion 342, vacuum is applied to the releasable holding means 54 by alignment of the vacuum passage 248 in connecting plate 244 with the arcuate vacuum chamber 250 in manifold member 252. As shown in FIG. 11, the vacuum passage 248 becomes aligned with vacuum chamber 250 at rotational position 510 along radial line 280 about 6° before the vertical centerline 46 so that vacuum holding of the can body member is effected before beginning the generally downward rotation after centerline 46. The vacuum chamber 250 extends circumferentially about 170° and terminates at radial line 282 about 16° before the lower vertical centerline 45 so that the vacuum is continuously applied to the releasable holding means for about 170° of rotation to effect vacuum holding of the can body members on the releasable holding means unless sooner terminated as hereinafter described.

Figure 17:
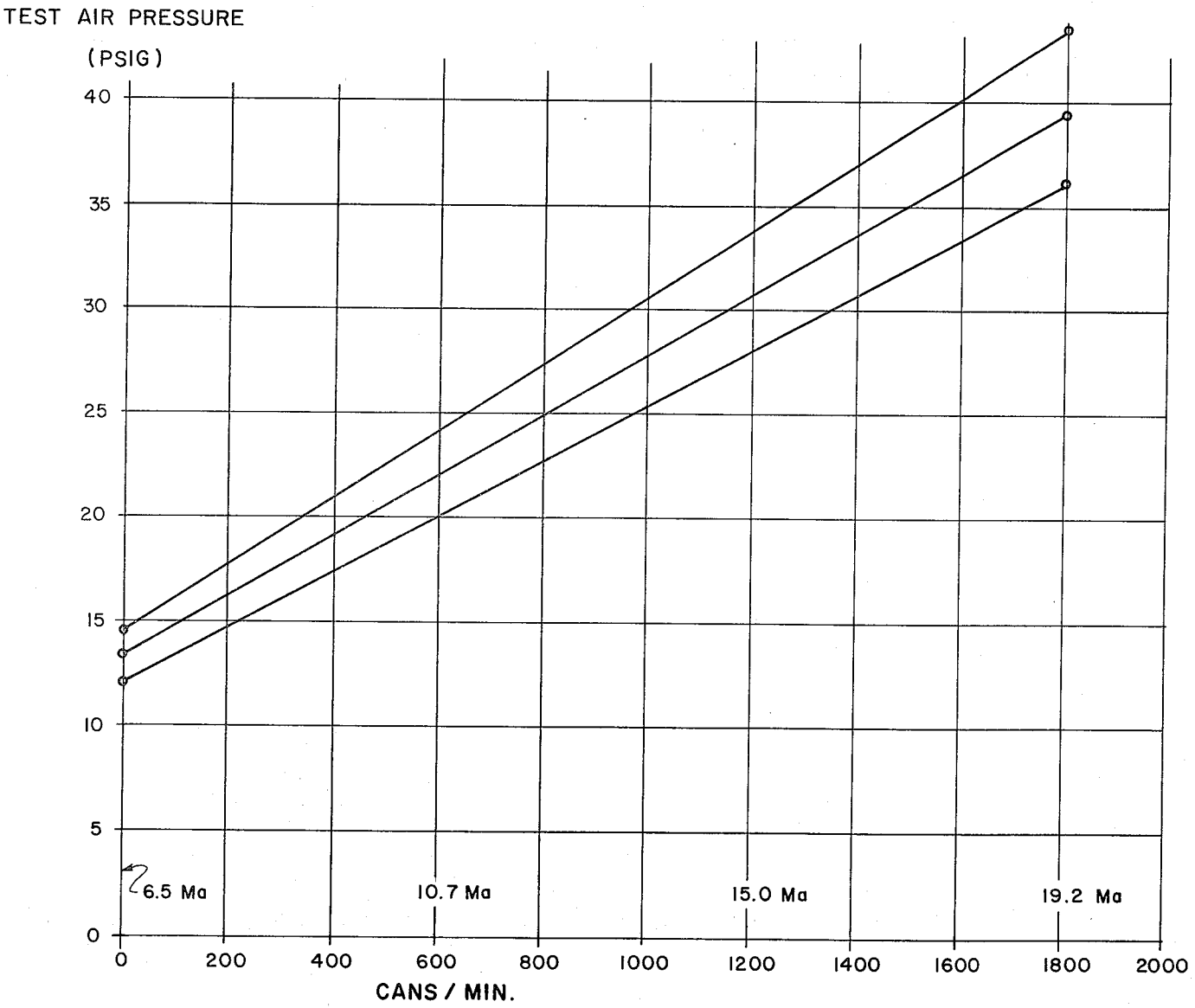
FIG. 17 is a graph showing the acceptable pressure range of apparatus at various speeds in a particular embodiment.

In addition, when, or preferably slightly before, the can body member has been axially shifted to locate flange portion 20 in engagement with the flexible sealing lip portion 342, pressurized air is applied to chamber 358 and the interior of the can body member by alignment of the associated one of the air passages 362, 363 in member 86 with the associated one of the arcuate air chambers 368, 370 in manifold member 366. The accurate air chambers 368, 370 in turn receive air at a predetermined pressure through control valve means 600 in fluid communication with an air pressure source (not shown). As shown in FIG. 11, the associated air passages and air chambers become aligned along radial line 280 about 6° before vertical centerline 46 so that pressurization of the sealing lip portion 342 and the interior of the can body member is initiated before beginning the generally downward rotational movement beyond centerline 46. As shown in FIG. 11, the associated air passages and air chambers remain aligned until reaching radial line 512 after about 50° of rotation beyond centerline 46. By the time the can body member reaches the test position 514 along radial line 383, an internal can pressurization of between 7 to 15 psi has been effected. The length of time that the associated air passages and air chambers remain aligned to produce the can body and seal pressurization is dependent upon the rotational speed of the rotatable shaft means. Thus at relatively low speeds of operation such as at 600 cans per minute, the pressurization period is considerably longer than at high speeds such as 1500 cans per minute and the discharge air pressure from control valve means 600 must accordingly be increased with increasing operation speed of the apparatus to maintain a relatively constant pressurization in the can body member and seal at the end of the pressurization period. As illustrated by FIG. 17 an operating envelop defined by a lower operating limit varying linearly between a pressure of approximately 20 psig at 600 cans per minute and 36.2 psig at 1800 cans per minute and an upper operating limit varying linearly between a pressure of approximately 24 psig at 600 cans per minute and 43.5 psig at 1800 cans per minute provides adequate results for an apparatus wherein the diameter of the air passages 362, 363 in member 86 and the associated accurate air chambers 368, 370 in manifold member 366 and the diameter of the connection conduit 610 between manifold member 366 and control valve means 600 have minimum diameters of approximately 5/16 inches and an overall conduit length from the control valve means discharge orifice 605 to air pressure chamber 349 of approximately 30 inches. The pressure values shown in FIG. 17 represent the pressure measured near the control valve means discharge orifice. The pressure values illustrated by FIG. 17 would of course be increased in a system having a greater conduit pressure drop between the control valve means 600 discharge orifice and the pressure chamber 349 and would be correspondingly decreased in a system having a smaller conduit pressure drop. The amount of such adjustment may be determined empirically or by conventional fluid analysis means well known in the art.

Thus, as the pressurized can body member is carried into alignment with the light testing means 62, any light passing from outside the can body member through any pin holes in the wall portions or through cracks in the flange portion 20 or between the sealing lip portion 342 and the rim portion 22 will be sensed by the photomultiplier tube and a defective can body member signal will be generated for purposes to be hereinafter described.

As soon as the test has been completed, the application of pressurized air to chamber 358 is terminated at rotational position 520 along radial line 512, FIG. 11. Then the extendable and retractable means 52 begin axial movement from the extended position to the retracted position and the axial movement is completed during about the next 40° of rotation so as to be located in the fully retracted position by the time the can body member reaches rotational position 522 along horizontal centerline 57. During the axial movement from the extended position to the retracted position, the can body member is held on the releasable holding means 54 by vacuum application through passage 218 and chamber 234 against the can body member bottom wall portion 17. Thus, the tested can body member is carried axially and slidably axially displaced relative to the aligned pockets 44 so as to be located in the retracted position illustrated in FIG. 8. In the retracted position, the flange portion 20 is axially spaced a substantial distance from the sealing means 56 and plate member 86 and the bottom wall portion 17 is located relatively closely axially adjacent the side surface 442 of guide plate 94.

Shortly after the can body member is carried generally downwardly, beyond the horizontal centerline 57, at rotational position 524 along radial line 290 10° below centerline 57, the air passage 286 in member 244 is rotated into alignment with air passage 288 in manifold member 252. The flow of pressurized air in passage 288 is controlled by conventional valve means (not shown) actuatable in response to a defective can body member control signal from the non-printed ink label detector means or from the light tester means 62 to permit flow of pressurized air therethrough. Thus, as air passage 286 begins to become aligned with air passage 288 at rotational position 528 along radial line 529 at about 7° below horizontal centerline 57 and when fully aligned at rotational position 524 about 10° below centerline 57, pressurized air is delivered to passage 218 in the releasable holding means 54 to dissipate the vacuum and blow-off a defective can body member.

When a defective can body member is released from the releasable holding means 54 at about rotational position 530, the inertial force on the can body member being carried by the rotating plate members 82, 84 causes the can body member to be separated from the pockets 44 and removed from the transfer wheel means in a generally vertical downward direction along a path of downward movement generally tangential to the circular path of movement of the pockets as indicated by arrow 532. The side surface 442 of guide plate member 94 is effective to axially confine the downward movement of the defective can body member after release from the releasable holding means. In addition, the side wall 436 of the discharge chute means 66 axially opposite guide plate member 94 extends upwardly and terminates at 443 above the radial line 529, whereat application of pressurized air begins, so as to also axially confine the defective can body member during downward movement in chute passage 440.

If no defective can body member signal has been generated, the vacuum is continuously applied to the releasable holding means 54 until the can body member reaches the unloading chute means 68. As shown in FIG. 12, the upper inlet end of the unloading chute means extends beyond the lower vertical centerline 45 about 16° so as to be substantially coterminous with vacuum chamber 250 along radial line 290. After vacuum passage 248 has been disconnected from vacuum chamber 250, air passage 286 is rotated into alignment with an air passage 534 at rotational position 536 along radial line 538. The passage 534 is continuously connected to a source of pressurized air (not shown) by suitable coupling and conduit means (not shown) similar to the means 292, 294, 296 of FIG. 5. As shown in FIG. 12, air passage 534 is located about 10° before lower vertical centerline 45. The upper surfaces 540 of the unloading chute rail member 470 extend generally tangentially relative to the circular path of movement of the pockets 44 at the radial line 538 so that as the can body members are released from the releasable holding means 54, the inertial force of the can body members is directed substantially parallel to the upper surfaces of the unloading chute means 68, as indicated by arrow 542, to enable removal of the can body members from the pockets of the transfer wheel means by inertial force and the effect of gravity. As the released can body member is moved further toward the vertical centerline 45, the upper guide plate 486 is effective to disassociate the can body member from the pockets 44 by relative movement between the can body member and surfaces 108, 114 of the plate members 82, 84. The can body members are rapidly discharged into chute passage 454 and rapidly move through the chute passage to outlet opening 456 which may be connected to a gravity type chute conveyor system (not shown). If a malfunction, such as jamming of can body members, occurs in the unloading operation, creating a high force condition, the rail members 470 will be downwardly pivoted against the bias of spring 478 to enable removal and discharge of can body members toward the discharge passage 440 and actuate a limit switch (not shown) to terminate operation of the apparatus.

It is contemplated that the invention concepts herein described may be variously otherwise embodied and it is intended that the appended claims be construed to include alternative embodiments of the invention except insofar as limited by the prior art.

What is claimed is:

1. A variable speed machine for continuous testing of one piece can body members having a sidewall portion, and a bottom wall portion at one end defining a container cavity, and an opening at the other end, and a formed flange portion at the other end surrounding the opening for subsequent association with a can closure member; the machine being adapted for testing the can body member for defects including pin holes in the sidewall portion and the bottom wall portion, and unwanted deformation and cracks in the flange portion, the machine being operable over a range of operating speeds and comprising:

frame and housing means for supporting and housing the machine components;

horizontally extending rotatable shaft means rotatably supported by said frame and housing means and providing a central axis of rotation;

motor means for causing continuous rotation of said rotatable shaft means;

can body member transfer wheel means mounted on said shaft means for rotation therewith and for carrying can body members in a circular path thereabout;

a plurality of pocket means circumferentially spaced about the outer periphery of said transfer wheel means for receiving a can body member in each pocket means and for transferring each can body member along said circular path during a portion of each revolution of said transfer wheel means;

in-feed means mounted on said frame and housing means for loading one can body member in each of said pocket means during each revolution of said transfer wheel means;

light applying means for applying light to the exterior surfaces of each can body member in each of said pocket means, the light applying means being non-rotatably mounted relative to said transfer wheel means and located to provide a continuous light zone during each revolution of said transfer wheel means;

discharge chute means for receiving defective can body members from said transfer wheel means during each revolution of said transfer wheel means;

unloading chute means for receiving non-defective can body members from said transfer wheel means during each revolution of said transfer wheel means;

extendable and retractable means mounted on said shaft means for rotation therewith and being associated with each of said pocket means for axially moving a can body member in each of said pocket means between a first retracted position and a second extended position during a portion of each revolution of said transfer wheel means;

releasable holding means associated with each of said extendable and retractable means for abutting and releasable holding engagement with the bottom wall portion of a can body member in each of said pocket means during a portion of each revolution of said transfer wheel means;

sealing means mounted on said shaft means for rotation therewith and being associated with each of said pocket means and each of said extendable and retractable means for sealable engagement with the flange portion of non-defective can body members carried in each of said pocket means and releasably held by said holding means, the holding means, being operative to effect holding engagement with the bottom wall of said can body member and the extendable and retractable means being operative from the first retracted position to the second extended position to effect sealable engagement of the flange portion of each can body member with the associated sealing means prior to movement of each can body member to said light zone;

light detection means non-rotatably mounted relative to said transfer wheel means and being located for successive axial alignment with each of said pocket means and the opening in the can body member carried thereby opposite said sealing means in the light zone for receiving light only from said light applying means through the can body member and between the flange portion and the sealing means and for generating a control signal upon receipt of light therefrom;

said extendable and retractable means being operative from the second extended position to the first retracted position to retract each can body member from sealable association with said sealing means after movement beyond said light detection means prior to reaching said discharge chute means during each revolution of said transfer wheel means;

defective can body member release control means effective in response to said control signal from said light detection means for releasing each defective can body member before reaching said discharge chute means during each revolution of said transfer wheel means;

non-defective can member release control means effective as each non-defective can body member approaches said unloading chute means for releasing each non-defective can body member and for enabling discharge of non-defective can body members into said unloading chute means during each revolution of said transfer wheel means;

pressurization means associated with each of said sealing means for applying pressurized air to said sealing means for obtaining minimal sealing area engagement between said sealing means and the flange portion of said can body members and for applying pressurized air through the opening to the interior of said can body member to outwardly flex the side wall portion and the bottom wall portion to enhance the passage of light through openings therein;

first passage means connected to a source of pressurized air for supplying pressurized air;

second passage means connected to each of said sealing means and connectable to said first passage means when each associated sealing means and pocket means are located in said light zone for pressurizing said sealing means and a can body member associated therewith in the light zone and prior to movement into axial alignment with said light detection means;

rotational speed monitoring means for monitoring the speed of said rotatable shaft means and providing a speed monitor signal;

processing means for receiving and processing said speed monitor signal and providing a processed control signal in response thereto for actuating control valve means; and control valve means operably connected in fluid communication with said first passage means and said second passage means for controlling the pressure of air provided to said sealing means responsive to changes in speed of said rotatable shaft means.

2. The invention of claim 1 wherein said rotational speed monitoring means comprises an encoder means for providing a continuous variable frequency electronic signal to said processing means the frequency of said signal being linearly related to the rotational speed of said rotatable shaft means.

3. The invention of claim 2 wherein said processing means comprises frequency to current converter means for converting said continuous variable frequency electronic signal to a variable electric current; said variable current flowing through a control current loop means for interface with current actuated control means.

4. The invention of claim 3 wherein said processing means comprises a current to pneumatic converter means operably connected to said control current loop means for generating a variable pressure pneumatic control signal responsive to said variable electric current flow through said current loop means.

5. The invention of claim 4 wherein said current to pneumatic converter means comprises pneumatic control line means for transmitting said variable pressure pneumatic control signal to said control valve means whereby said control valve means is variably controllable responsive to said pneumatic control signal within a preselectable discharge pressure range.

6. The invention of claim 1 wherein said control valve means is variably controllable within a preselectable discharge pressure range and wherein said variable speed machine further comprises calibration means for selectably setting said preselectable discharge pressure range.

7. The invention of claim 5 further comprising calibration means for selectably setting said preselectable discharge pressure range.

8. The invention of claim 7 wherein said sealing means comprises:

an annular rotatable support plate member mounted on said shaft means for continuous rotation therewith in fixed relationship to said transfer wheel means and having a radially outwardly extending inner side surface next adjacent said transfer wheel means and a radially outwardly extending outer side surface next adjacent said light detection means;

a multiplicity of equally circumferentially spaced transverse passages extending through said annular support plate member between the side surfaces thereof and being equally radially outwardly spaced from said central axis of rotation;

said transverse passages being equal in number to the number of said pocket means and being coaxially aligned therewith;

a flexible sealing member mounted on the inner side surface of said annular support plate member in circumjacent relationship to each of said transverse passages; and a flexible resilient sealing lip portion on each sealing member defining an annular opening and having an annular outer side surface next adjacent said transfer wheel means for abutting sealable engagement with the flange portion of a can body member, and having an inner side surface for application of axially outwardly directed sealing force.

9. The invention of claim 8 wherein said flexible resilient sealing lip portion on said sealing member comprises: a flange overlap portion for overlappingly touchingly engaging a limited portion of said flange portion of a can body member and a balloon portion extending radially inwardly from said flange overlap portion in nontouching relationship with said can body member, said balloon portion being axially extended into a gap defined by said can body member outer wall and a wall defined by an associated transverse passage.

10. The invention of claim 9 wherein the thickness of said sealing lip portion between said outer side surface and said inner side surface comprises a range from 0.040 inches to 0.080 inches.

11. The invention of claim 9 wherein the radial extending width of said overlap portion comprises a range of said sealing lip portion between 0.160 inches and 0.250 inches.

12. The invention of claim 9 wherein the radially extending width of said balloon portion of said sealing lip portion comprises a range between 0.180 inches and 0.350 inches.

13. The invention of claim 9 wherein said sealing lip portion comprises an integrally formed homogenous material having a durometer between 65A and 75A.

14. The invention of claim 9 wherein the thickness of said sealing lip portion between said outer side surface and said inner side surface comprises a range between 0.040 inches to 0.080 inches, and wherein said radially extending width of said overlap portion of said sealing lip comprises a range between 0.160 inches and 0.250 inches, and wherein the radially extending width of said balloon portion of said sealing lip portion comprises a range between 0.180 inches and 0.350 inches, and wherein said sealing lip portion comprises an integrally formed homogeneous material having a durometer between 65A and 75A.

15. The invention of claim 8 wherein the maximum pressure within a can body member during the period of sealing relationship between said can body member and said sealing means comprises a range between 7 PSI and 15 PSI.

16. The invention of claim 9 wherein the relationship between the rotational speed of said rotatable shaft means and the discharge pressure provided by said apparatus at said control valve means is substantially linear.

17. The invention of claim 16 wherein the volume of said cavity of a can body member is substantially 26 cubic inches.

18. The invention of claims 14, 15, 16 or 17 wherein the said machine has an acceptable speed pressure operating range defined by a lower range comprising a control valve discharge pressure of approximately 12 psig at 0 cans per minute and approximately 36 psig at 1800 cans per minute and varying substantially linearly therebetween and an upper range comprising a control valve discharge pressure of approximately 15 psig at 0 cans per minute and 43 psig at 1800 cans per minute and varying substantially linearly therebetween.

19. The invention of claims 9 or 18 wherein the control current varies within a range between 4 milliamps and 20 milliamps and wherein the pneumatic control signal pressure varies within a range substantially between 3 psig and 15 psig.

20. The invention of claim 7 wherein said current to pneumatic converter means comprise pneumatic converter control means for adjusting said variable pressure pneumatic control signal with respect to said variable electric current.

21. A variable speed machine for continuous testing of articles by use of pressurized air, the machine being operable over a range of operating speeds and comprising:

frame and housing means for supporting and housing the machine components;

horizontally extending rotatable shaft means rotatably supported by said frame and housing means and providing a central axis of rotation;

motor means for causing continuous rotation of said rotatable shaft means;

article transfer wheel means mounted on said shaft means for rotation therewith and for carrying articles in a circular path thereabout;

a plurality of pocket means circumferentially spaced about the outer periphery of said transfer wheel means for receiving an article in each pocket means and for transferring each article along said circular path during a portion of each revolution of said transfer wheel means;

extendable and retractable means mounted on said shaft means for rotation therewith and being associated with each of said pocket means for axially moving an article in each of said pocket means between a first retracted position and a second extended position during a portion of each revolution of said transfer wheel means;

releasable holding means associated with each of said extendable and retractable means for abutting and releasable holding engagement with a portion of an article in each of said pocket means during a portion of each revolution of said transfer wheel means;

sealing means mounted on said shaft means for rotation therewith and being associated with each of said pocket means and each of said extendable and retractable means for sealable engagement with a portion of an article carried in each of said pocket means and releasably held by said holding means, the holding means being operative to effect holding engagement with the article and the extendable and retractable means being operative from the first retracted position to the second extended position to effect sealable engagement of a portion of each article with the associated sealing means in a test position;

pressurization means associated with each of said sealing means for applying pressurized air to said sealing means for effecting sealing engagement between said sealing means and said articles;

first passage means connected to a source of pressurized air for supplying pressurized air;

second passage means connected to each of said sealing means and connectable to said first passage means when each associated sealing means and pocket means are located at said test position for pressurizing said sealing means;

rotational speed monitoring means for monitoring the speed of said rotatable shaft means and providing a speed monitor signal;

processing means for receiving and processing said speed monitor signal and providing a processed control signal in response thereto for actuating control valve means; and control valve means operably connected in fluid communication with said first passage means and said second passage means for controlling the pressure of air provided to said sealing means responsive to changes in speed of said rotatable shaft means.

22. The invention of claim 21 wherein said rotational speed monitoring means comprises an encoder means for providing a continuous variable frequency electronic signal to said processing means the frequency of said signal being linearly related to the rotational speed of said rotatable shaft means.

23. The invention of claim 22 wherein said processing means comprises frequency to current converter means for converting said continuous variable frequency electronic signal to a variable electric current; said variable current flowing through a control current loop means for interface with current actuated control means.

24. The invention of claim 23 wherein said processing means comprises a current to pneumatic converter means operably connected to said control current loop means for generating a variable pressure pneumatic control signal responsive to said variable electric current flow through said current loop means.

25. The invention of claim 24 wherein said current to pneumatic converter means comprises pneumatic control line means for transmitting said variable pressure penumatic control signal to said control valve means whereby said control valve means is variably controllable responsive to said pneumatic control signal within a preselectable discharge pressure range.

26. The invention of claim 21 wherein said control valve means is variably controllable within a preselectable discharge pressure range and wherein said variable speed machine further comprises calibration means for selectably setting said preselectable discharge pressure range.

27. The invention of claim 25 further comprising calibration means for selectably setting said preselectable discharge pressure range.

28. The invention of claim 27 wherein said sealing means comprises:

an annular rotatable support plate member mounted on said shaft means for continuous rotation therewith in fixed relationship to said transfer wheel means and having a radially outwardly extending inner side surface next adjacent said transfer wheel means and a radially outwardly extending outer side surface next adjacent said light detection means;

a multiplicity of equally circumferentially spaced transverse passages extending through said annular support plate member between the side surfaces thereof and being equally radially outwardly spaced from said central axis of rotation;

said transverse passages being equal in number to the number of said pocket means and being coaxially aligned therewith;

a flexible sealing member mounted on the inner side surface of said annular support plate member in circumjacent relationship to each of said transverse passages; and a flexible resilient sealing lip portion on each sealing member defining an annular opening and having an annular outer side surface next adjacent said transfer wheel means for abutting sealable engagement with the flange portion of a can body member, and having an inner side surface for application of axially outwardly directed sealing force.

29. The invention of claim 28 wherein said flexible resilient sealing lip portion on said sealing member comprises: a flange overlap portion for overlappingly touchingly engaging a limited portion of said flange portion of a can body member and a balloon portion extending radially inwardly from said flange overlap portion in non-touching relationship with said can body member, said balloon portion being axially extended into a gap defined by said can body member outer wall and a wall defined by an associated transverse passage.

30. The invention of claim 29 wherein the thickness of said sealing lip portion between said outer side surface and said inner side surface comprises a range from 0.040 inches to 0.080 inches.

31. The invention of claim 29 wherein the radial extending width of said overlap portion comprises a range of said sealing lip portion between 0.160 inches and 0.250 inches.

32. The invention of claim 29 wherein the radially extending width of said balloon portion of said sealing lip portion comprises a range between 0.180 inches and 0.350 inches.

33. The invention of claim 29 wherein said sealing lip portion comprises an integrally formed homogenous material having a durometer between 65A and 75A.

34. The invention of claim 29 wherein the thickness of said sealing lip portion between said outer side surface and said inner side surface comprises a range between 0.040 inches to 0.080 inches, and wherein said radially extending width of said overlap portion of said sealing lip comprises a range between 0.160 inches and 0.250 inches, and wherein the radially extending width of said balloon portion of said sealing lip portion comprises a range between 0.180 inches and 0.350 inches, and wherein said sealing lip portion comprises an integrally formed homogeneous material having a durometer between 65A and 75A.

35. The invention of claim 28 wherein the maximum pressure within a can body member during the period of sealing relationship between said can body member and said sealing means comprises a range between 7 PSI and 15 PSI.

36. The invention of claim 29 wherein the relationship between the rotational speed of said rotatable shaft means and the discharge pressure provided by said apparatus at said control valve means is substantially linear.

37. The invention of claim 36 wherein the volume of said cavity of a can body member is substantially 26 cubic inches.

38. The invention of claim 34 wherein the said machine has an acceptable speed pressure operating range defined by a lower range comprising a control valve discharge pressure of approximately 12 psig at 0 cans per minute and approximately 36 psig at 1800 cans per minute and varying substantially linearly therebetween and an upper range comprising a control valve discharge pressure of approximately 15 psig at 0 cans per minute and 43 psig at 1800 cans per minute and varying substantially linearly therebetween.

39. The invention of claim 29 wherein the control current varies within a range between 4 milliamps and 20 milliamps and wherein the pneumatic control signal pressure varies within a range substantially 3 psig and 15 psig.

40. The invention of claim 27 wherein said current to pneumatic converter means comprise pneumatic converter control means for adjusting said variable pressure pneumatic control signal with respect to said variable electric current.

41. A pressure control system for a variable speed testing device of the type using pressurized air for testing articles carried by a rotatable transfer wheel wherein the articles are tested during a partial revolution of the wheel during a predetermined period of sealed engagement of an article with a sealing apparatus which receives air from an air passage connected to a pressurized air source, the control apparatus comprising:

rotational speed monitoring means for monitoring the speed of said rotatable transfer wheel and providing a speed monitor signal;

processing means for receiving and processing said speed monitor signal and providing a speed based control signal in response thereto for actuating control valve means; and control valve means operably connected in fluid communication with said air passage for controlling the pressure of air provided to said sealing apparatus responsive to said speed based control signal.

42. The invention of claim 41 wherein said rotational speed monitoring means comprises an encoder means for providing a continuous variable frequency electronic signal to said processing means the frequency of said signal being linearly related to the rotational speed of said rotatable transfer wheel.

43. The invention of claim 42 wherein said processing means comprises frequency to current converter means for converting said continuous variable frequency electronic signal to a variable electric current; said variable current flowing through a control current loop means for interface with current actuated control means.

44. The invention of claim 43 wherein said processing means comprises a current to pneumatic converter means operably connected to said control current loop means for generating a variable pressure pneumatic control signal responsive to said variable electric current flow through said current loop means.

45. The invention of claim 44 wherein said current to pneumatic converter means comprises pneumatic control line means for transmitting said variable pressure pneumatic control signal to said control valve means whereby said control valve means is variably controllable responsive to said pneumatic control signal within a preselectable discharge pressure range.

46. The invention of claim 44 further comprising calibration means for selectably setting said preselectable discharge pressure range.

47. The invention of claim 44 wherein the control current varies within a range between 4 milliamps and 20 milliamps and wherein the pneumatic control signal pressure varies within a range substantially between 3 psig and 15 psig.

48. The invention of claim 47 wherein said current to pneumatic converter means comprise pneumatic converter control means for adjusting said variable pressure pneumatic control signal with respect to said variable electric current.

* * * * *